US007207636B2

(12) United States Patent
Livingston et al.

(10) Patent No.: US 7,207,636 B2
(45) Date of Patent: Apr. 24, 2007

(54) MODULAR CABINET SYSTEM

(75) Inventors: Steven J. Livingston, San Francisco, CA (US); Peter Hans Müller, Woodside, CA (US)

(73) Assignee: I.D. Furniture Systems, Inc., San Francisco, CA (US)

( * ) Notice: Subject to any disclaimer, the term of this patent is extended or adjusted under 35 U.S.C. 154(b) by 0 days.

(21) Appl. No.: 10/933,164

(22) Filed: Sep. 1, 2004

(65) Prior Publication Data

US 2005/0073224 A1 Apr. 7, 2005

Related U.S. Application Data

(60) Provisional application No. 60/500,099, filed on Sep. 3, 2003.

(51) Int. Cl.
*A47B 47/00* (2006.01)

(52) U.S. Cl. ..... 312/265.6; 52/656.1

(58) Field of Classification Search ..... 312/257.1, 312/265.5, 265.6, 326, 329, 109, 138.1; 52/656.1, 52/656.9, 455

See application file for complete search history.

(56) References Cited

U.S. PATENT DOCUMENTS

| | | | | |
|---|---|---|---|---|
| 1,282,719 A | | 10/1918 | Storvick | |
| 2,291,719 A | * | 8/1942 | Huehnel | 220/327 |
| 2,816,632 A | * | 2/1957 | Nardulli | 52/656.7 |
| 3,296,745 A | * | 1/1967 | Johnson et al. | 49/501 |
| 3,403,953 A | | 10/1968 | Clark | |

(Continued)

FOREIGN PATENT DOCUMENTS

| | | |
|---|---|---|
| EP | 1 223 351 | 7/2002 |

(Continued)

OTHER PUBLICATIONS

Home & Garden Television (web page). Modular Kitchens. 2003. http://www.hgtv.com/hgtv/shows_kde_episode/0,1806,HGTV_3860_6561,00.html.

(Continued)

*Primary Examiner*—James O. Hansen
(74) *Attorney, Agent, or Firm*—Michael A. Glenn; Glenn Patent Group

(57) ABSTRACT

A modular cabinet structure, process, and system are provided, in which a modular cabinet structure comprises a structural frame comprising a first side and a second side, and a first end and a second end opposite the first end, wherein the frame structure comprises a removable frame component at the second end; and a face assembly; wherein the face assembly is fixedly retained within the frame structure when the removable frame component is affixed to the frame structure; and wherein the face assembly is movable in relation the frame structure when the removable frame component is detached from the frame structure. In frame-style embodiments, the face assembly comprises a central panel having a front surface and a back surface, a retaining assembly attached to the back surface of the central panel, and a face frame having a front surface and a rear surface attached to the central panel. In full panel-style embodiments, the face assembly typically comprises a full panel having a front surface and a back surface, and a retaining assembly attached to the back surface of the panel. The modular cabinet structures can be used for cabinet doors and/or cabinet drawers, such that the face assemblies are readily installed and/or replaced.

71 Claims, 22 Drawing Sheets

U.S. PATENT DOCUMENTS 3,533,190 A * 10/1970 Johnson et al. ..... 49/501
3,729,241 A 4/1973 Schippers et al.
3,826,551 A * 7/1974 Schwartz ..... 312/140
3,857,619 A 12/1974 Adisckes
3,877,765 A 4/1975 Hassing
3,892,452 A 7/1975 Williams et al.
3,899,258 A * 8/1975 Matthews ..... 403/292
3,936,107 A 2/1976 Gourdeau et al.
3,952,473 A * 4/1976 Jesse ..... 52/656.1
4,158,277 A 6/1979 Krempp et al.
4,183,187 A * 1/1980 Simard ..... 403/401
4,240,765 A * 12/1980 Offterdinger ..... 403/402
4,337,988 A 7/1982 Schenck
4,400,044 A 8/1983 Yoshiyuki
4,707,204 A * 11/1987 Heeg ..... 156/91
4,783,945 A * 11/1988 Heeg ..... 52/656.4
4,831,804 A * 5/1989 Sayer ..... 52/475.1
4,987,713 A * 1/1991 Delafield ..... 52/204.597
4,991,369 A 2/1991 Lamb
5,165,770 A 11/1992 Hahn
5,184,886 A 2/1993 Handley et al.
5,220,764 A 6/1993 James
5,483,779 A * 1/1996 Crawford et al. ..... 52/645
5,485,705 A * 1/1996 Guillemet ..... 52/656.9
5,571,276 A 11/1996 Kobos et al.
5,603,557 A 2/1997 Marks et al.
5,704,699 A 1/1998 Pagelow et al.
5,718,493 A 2/1998 Nikolai
5,875,599 A 3/1999 McGrath et al.
5,951,127 A 9/1999 Smith
6,053,585 A * 4/2000 Osen ..... 312/204
6,152,553 A 11/2000 Wunderlich
6,267,462 B1 7/2001 Krause et al.
2002/0017117 A1 2/2002 Sunshine et al.
2002/0171332 A1 11/2002 Skov et al.

FOREIGN PATENT DOCUMENTS

ES 2066677 3/1995

OTHER PUBLICATIONS

Kitchen Fronts of GA(web page). Why Reface Your Cabinets. 2003. htpp://www.kitchenfrontsofga.com/yreface.htm.
Homecraft Kitchen Cabinet & Refacing(web page). Real Wood Cabinet Refacing by Homecraft. http://www.homecraftcabinets.com/Refacing_your_Kitchen_cabinets.html.
Step by Step Instructions to Refacing(web page article). http://www.kitchenrefacing.org/reface1.html.
600 Series Framed panel Applications(web page document). Sub-Zero Corporation of Madison Wisconsin. http://www.subzero.com/subzero/subzeropdfs/600framed.pdf.
600 Series Overlay Panel Applications(web page document). Sub-Zero Corporation of Madison Wisconsin. http://www.subzero.com/subzero.
Sub-Zero 600 Series(web page). Sub-Zero Corporation of Madison Wisconsin. http://www.subzero.com/subzero/600series.asp.

* cited by examiner

MODULAR CABINET SYSTEM

CROSS-REFERENCE TO RELATED APPLICATIONS

This application claims priority from LIVI0001PR, U.S. Provisional Patent Application Ser. No. 60/500,099, filed 3 Sep. 2003, which is incorporated herein by reference.

FIELD OF THE INVENTION

The invention relates to the field of cabinet systems. More particularly, the invention relates to improved cabinet structures and processes.

BACKGROUND OF THE INVENTION

Individual homeowners and developers of residential projects currently desire more choice in the cabinetry market, and better control of the process of selecting, ordering, installing, and/or renovating kitchen cabinets. The vast majority of kitchen cabinet companies manufacture nearly identical products, mostly traditional door styles in a limited selection of finishes, typically with limited interior options and hardware.

Currently, when a homeowner is required to choose a cabinet system, they are limited to the door styles and finishes offered by the selected manufacturer. Once installed in the home, these cabinets cannot be changed without completely remodeling the kitchen, requiring the homeowner to throw out the existing cabinet system, or somehow recycle the system, which is difficult and rarely done. During a conventional remodeling process, the homeowner is typically left without a functioning kitchen for weeks or months.

This lack of flexibility is the direct cause of the generic look of most kitchen cabinets, as owners are hesitant to make a significant investment in something that is considered unusual or different, which they might tire of before they are financially and emotionally ready to remodel. Most kitchens are in place for several years, e.g. often at least ten to fifteen years, before the existing homeowner or new purchaser remodels the kitchen, which represents a significant, long-term investment in a chosen cabinet style.

With the exception of low end, or "off the shelf" products, such as currently sold through warehouse stores, e.g. Ikea, Home Depot, the average delivery time for medium high and high-end, fabricated to order cabinetry is several weeks, e.g. 10 to 12 weeks, for domestic cabinetry, and can extend up to several months, e.g. often 16 to 20 weeks or more, for European cabinetry. Prior to ordering, an additional several weeks to months are required to develop the design layout and generate fabrication drawings. This time frame requires the purchaser to make a commitment to their cabinetry style and supplier far in advance of the actual need for cabinetry.

While there are currently numerous manufacturers and suppliers of cabinets, there are no kitchen cabinet manufacturers that offer a readily changeable product. As well, there are few if any manufacturers and suppliers that provide modular and renovatable cabinets for the upper middle range clients who desire contemporary, European styling in their cabinetry.

It would be advantageous to provide a cabinet system that provides a wide variety of styles, materials, and finishes, which also provides the ability to change and upgrade existing cabinets. The development of such a cabinet system would constitute a major technological advance.

As well, countertops and appliances are purchased from separate suppliers, which requires substantial coordination on the part of the contractor or the homeowner. Countertops are usually measured for and put in to production after the cabinets are in place, which results in a long period when a kitchen installation is at virtually a standstill.

A common complaint in the cabinetry industry is a lack of customer service, particularly after delivery of the cabinetry, and unresponsiveness by the cabinet manufacturer. Kitchen design firms often devote a large portion of their project management time and efforts to post-delivery punch list items, such as getting replacement parts for items damaged on site or missing from delivery, which causes completion delays and frustrates both the retailers' staff and their clients. Even if the design was excellent, the fabrication and installation correct and the product beautiful, a client's final impression of the overall project is often influenced by any problems experienced trying to obtain those final few items required to complete the kitchen.

Developers of high-rise projects or multi-family housing developments are often concerned with the cost and completion of construction projects. The cost and availability of cabinetry systems is therefore critical to the developer market. To a developer, a choice of cabinets often has less to do with aesthetics and style and more to do with selecting a supplier who can deliver accurately and on-time, allowing them to complete units and receive a corresponding Certificate of Occupancy, which typically is required to trigger the release of construction funds, and to allow the developer to sell the unit.

Currently, high-rise projects, such as the Four Seasons in San Francisco, typically offer a limited choice of cabinetry styles for the purchaser of a new unit. The result is that most or all kitchens often have identical cabinetry, with higher priced units, such as on higher floors, having larger layouts and perhaps a better finish. Purchasers willing to "upgrade" and pay the difference are often not permitted to do so, as developers contract with one company for all units in a project. In addition, the administrative difficulties associated with tracking such upgrades are often more trouble for the developer than the potential profit is worth. The result is often that purchasers of condominium units receive a kitchen that is virtually identical to that of their neighbors, even in the high-end, luxury market.

In addition to the need to obtain Certificates of Occupancy in a timely manner, developers of multi-family housing projects often leave the selection of a cabinet manufacturer until quite late in the construction process. As a result, their choice of vendor is limited to those who can supply the cabinetry within the necessary construction schedule. Delays in the delivery of cabinetry can impact the other trades involved in the construction and cost the developers substantial sums in construction financing interest.

While post delivery problems can cause frustration and ill will with the individual retail consumers, customer service is perhaps even more critical to the developer market. If a significant element is missing, arrives damaged or is damaged on-site, replacements must be obtained as quickly as possible to avoid construction schedule delays and the possibility of the developer losing his "time slot" with other trades. Unfortunately, it is an accepted truism in the cabinetry industry that replacement parts can take longer to obtain than the original kitchen.

At the upper end of the multi-family housing market, there is currently a significant problem with purchasers who demolish an existing kitchen, in order to remodel to suit their own taste before moving in. With thousands of high-end multi-family projects recently completed or currently under development, it is clear that a serious problem exists, both in the waste of natural resources, and to the landfill required to dispose of the discarded cabinetry.

It would therefore be ecologically advantageous to provide a modular cabinet system that provides an alternative to the total demolition of kitchen units during a renovation project. The development of such a system would constitute a further technological advance.

Modular cabinetry has previously been described for a variety of applications, such as to provide improvements in the initial assembly of cabinet structures, and/or to provide structures for other applications, such as for appliances and/or furniture.

X. Johnson and G. Hilfinger, Composite Door for Cabinets and the Like, U.S. Pat. No. 3,296,745 (10 Jan. 1967) describe a composite door which "includes a central panel, usually of wood, and an outer metal frame around the entire panel and over the edges thereof."

G. Hilfinger and X. Johnson, Composite Door, U.S. Pat. No. 3,533,190 (13 Oct. 1970) describe a "composite door having a metal frame and a central door panel is designed particularly for kitchen cabinets. In one form, the central panel includes a front, decorative layer being therebetween and allowed to float to accommodate temperature and humidity changes. The frame can include upper and lower die-cast frame members having integral tongues received in end channels of extruded side frame members. In this manner, doors of various lengths can be made simply by changing the length of the extruded side frame members. Also, the door can be made of four die-cast corner frame members with tongues received in extruded side frame members, a swell as extruded upper and lower frame members. With this arrangement, door of any size can be made by changing the lengths of the extrusions. The door also has other unique features including an arrangement for holding decorative strips."

M. Schwartz, Doors, Drawer Fronts and Like Structures for Cabinets, Closets and Furniture, U.S. Pat. No. 3,826,551 (30 Jul. 1974) describes a "modular construction for rectangular doors, drawer fronts and like components of cabinets, closets, articles of furniture and the like is disclosed. Any such component includes a peripheral frame composed of four interlocked, preferably mitered, end butted side members, and a central panel or insert overlying the central opening of the frame and removably retained in place at the rear of the frame. The side members of the frame are injection molded of polystyrene or other suitable synthetic plastic material to basically identical constructions, each member being provided at one end thereof with an integral male connecting portion and at its other end with a matching recessed or female connecting portion to enable the four side members of the frame to be snapped together firmly at perfect right angles to each other. After assembly, the side members of the frame may be permanently cemented or bonded to one another at their junctures, and detachable back members may be screwed or otherwise secured to the back of the frame to assist in retaining the insert in place. All the structural units, i.e., the side and back members and the inserts, can be produced in a broad range of sizes. The invention thus makes it possible for a dealer to stock a relatively small selection of side members, inserts and back members of various sizes while yet being able to form therefrom a far larger number of combinations."

O. Heeg, Method of Making a Furniture Front Element, U.S. Pat. No. 4,707,204 (17 Nov. 1987) describes "a furniture front element like a cabinet door, of which the frame leg members are joined in mitre cut and without any screwed connection. The lengths of the leg members are infinitely adjustable and the frame filling pieces are designed as a storage means in order to be able to change the front surface of the element to the desired extent"

O. Heeg, Furniture Front Element; U.S. Pat. No. 4,783,945 (15 Nov. 1988) describes "A furniture front element like a cabinet door, of which the frame leg members are joined in mitre cut and without any screwed connection. The lengths of the leg members are infinitely adjustable and the frame filling pieces are designed as a storage means in order to be able to change the front surface of the element to the desired extent."

F. Delafield, Technique for Mounting Panels for Furniture; U.S. Pat. No. 4,987,713 (29 Jan. 1991), describes a "frame and strip assembly for mounting an edge portion of a panel. The assembly includes a frame member having a channel-like recess for receiving the edge portion of the panel and a mounting strip adapted to be received in the recess. The strip includes a base and a pair of opposed side walls defining a generally U-shaped cross section. The upper portion of each of the side walls of the mounting strip defines a transversely extending wing-like flange. The flanges and the side walls of the mounting strip are in a substantially continuous and coextensive engagement with the frame member adjacent to the recess and the panel to suspend the edge portion of the panel in the frame member and to firmly secure the edge portion of the panel in the mounting strip, thereby both preventing contact between the panel edge and the frame member and movement between the panel edge and the mounting strip."

D. Kobos, G. Lindgren, and J. Ferencevich, Dishwasher Front Panel Retainer Channel; U.S. Pat. No. 5,571,276 (5 Nov. 1996) describe "A channel member is provided which is configured to be held on the frame of an appliance. The frame includes a lip perpendicular to a first portion of the frame with a flange extending perpendicular to the lip parallel to and in the direction of the first portion of the frame. At least one tab projects out of the first portion of the frame. The channel member is configured to receive a retaining strip having a projecting portion. The channel member has a channel portion and a back portion. The back portion extends between the lip and the tab and has a portion retainingly held by the tab. The channel portion comprises a first resilient leg and a second resilient leg. The first and second legs are spaced apart to form a channel for receiving the projecting portion of the retaining strip. At least one of the first and second legs has a detent formed thereon to retainingly engage the projection. The second leg is configured to at least partially be received in an area defined by the first portion of the frame, the lip and the flange and yet to avoid engaging interference with the flange."

As well, some appliances available through Sub-Zero Corporation, of Madison Wis., feature appliance door assemblies which comprise a variety of door fronts, such as 600 Series framed door panels and overlay door panels.

Other documents provide technological background regarding cabinet structures and processes, such as: Modular Shelving with Cabinet, European Patent Application No. EP 1 223 351 A2; Integrated Laundry Center, U.S. Patent Application Publication No. US 2002/0017117 A1; Modular Shelving with Cabinet, U.S. Patent Application Publication No. US 2002/0171332 A1; T. Lamb, Window with Removable Fixed Window Sash, U.S. Pat. No. 4,991,369 (12 Feb. 1991); C. James, Front Panel Assembly for Barbecue Grill Carts, U.S. Pat. No. 5,220,764 (22 Jun. 1993); R. Clark, Device for Renovating Old Cabinets, U.S. Pat. No. 3,403, 953 (01 Oct. 1968); I. Storvick, Corner-Joint for Knock-down Show-Cases and Other Structures, U.S. Pat. No. 1,282,719 (22 Oct. 1918); E. Hassing, Furniture Structure; U.S. Pat. No. 3,877,765 (15 Apr. 1975); R. McGrath and R. Jutte, Modular Insulation Panels and Insulated Structures, U.S. Pat. No. 5,875,599 (2 March 1999); D. Wunderlich, Modular Furniture Construction System, U.S. Pat. No. 6,152,553 (28 Nov. 2000); R. Hahn, Electronic Equipment Modular Cabinet System, U.S. Pat. No. 5,165,770 (24 Nov. 1992); F. Adickes, Modular Cabinet System, U.S. Pat. No. 3,857,619 (31 Dec. 1974); C. Williams, A. Villa, and D. Humphrey, Modular Cabinet Assembly, U.S. Pat. No. 3,892,452 (01 Jul. 1975); R. Schenck, Modular Furniture System, U.S. Pat. No. 4,337,988 (6 Jul. 1982); H. Yoshiyuki, Modular Cabinet System, U.S. Pat. No. 4,400,044 (23 Aug. 1983); D. Handley and P. Costigan, Modular Bar System, U.S. Pat. No. 5,184,886 (09 Feb. 1993); S. Pagelow, J. Whalen, D. Bullis Jr., and D. Seals, Modular Cabinet System, U.S. Pat. No. 5,704,699 (6 Jan. 1998); G. Nikolai, Cabinet Construction System, U.S. Pat. No. 5,718,493 (17 Feb. 1998); J. Smith, Modular Interlocking Cabinets; U.S. Pat. No. 5,951,127 (14 Sep. 1999); H. Krause and H. Welke, Cabinet System, U.S. Pat. No. 6,267,462 B1 (31 Jul. 2001); W. Gourdeau and R. Hahn, Door Construction, U.S. Pat. No. 3,936,107 (3 Feb. 1976); L. Marks and R. Spiegel, Appliance Front Panel Retainer; U.S. Pat. No. 5,603,557 (18 Feb. 1997); Modular Cabinet System for Office; Spain Patent No. ES 2066677; Modular Kitchens, Home & Garden TV, as seen at www.hgtv.com/hgtv/shows_kde/episode/0,1806,HGTV_3860_6561,00.html, 2003; Why Reface Your Cabinets, Kitchen Fronts of GA, as seen at http://www.kitchenfrontsofga.com/yreface.htm, 2003; Real Wood Cabinet Refacing by Homecraft, Homecraft Kitchen Cabinet & Refacing, as seen at http://www.homecraftcabinets.com/Refacing_your_Kitchen_cabinets.html; and Step by Step Instructions to Refacing, as seen at http://www.kitchenrefacing.org/reface1.html.

While cabinet systems have previously been described, most prior modular cabinet structures are associated with modularity for the sake of ease of initial fabrication, and fail to address later service, renovation or reuse of cabinet structures.

It would therefore be advantageous to provide a modular cabinet structure and method, and an associated system, which readily allow service, renovation or reuse of cabinet structures, such as to efficiently renovate a kitchen with new face panels, while retaining cabinet caracasses and the structural frames of the cabinetry. The development of such a cabinet system would constitute a major technological advance.

In addition, the cabinetry industry has not adopted currently available technologies, resulting in unnecessary mistakes in ordering and fabrication and delays in obtaining and tracking the delivery of necessary parts.

It would therefore be advantageous to provide a cabinet business management system and associated processes, such as associated with a modular cabinet system, to provide integrated information, sales, ordering, tracking, and/or service. The development of such a system would constitute a further technological advance.

SUMMARY OF THE INVENTION

A modular cabinet structure, process, and system are provided, in which a modular cabinet structure comprises a structural frame comprising a first side and a second side, and a first end and a second end opposite the first end, wherein the frame structure comprises a removable frame component at the second end; and a face assembly; wherein the face assembly is fixedly retained within the frame structure when the removable frame component is affixed to the frame structure; and wherein the face assembly is movable in relation the frame structure when the removable frame component is detached from the frame structure. In frame-style embodiments, the face assembly comprises a central panel having a front surface and a back surface, a retaining assembly attached to the back surface of the central panel, and a face frame having a front surface and a rear surface attached to the central panel. In full panel-style embodiments, the face assembly typically comprises a full panel having a front surface and a back surface, and a retaining assembly attached to the back surface of the panel. The modular cabinet structures can be used for cabinet doors and/or cabinet drawers, such that the face assemblies are readily installed and/or replaced.

DETAILED DESCRIPTION OF PREFERRED EMBODIMENTS

Figure 1:
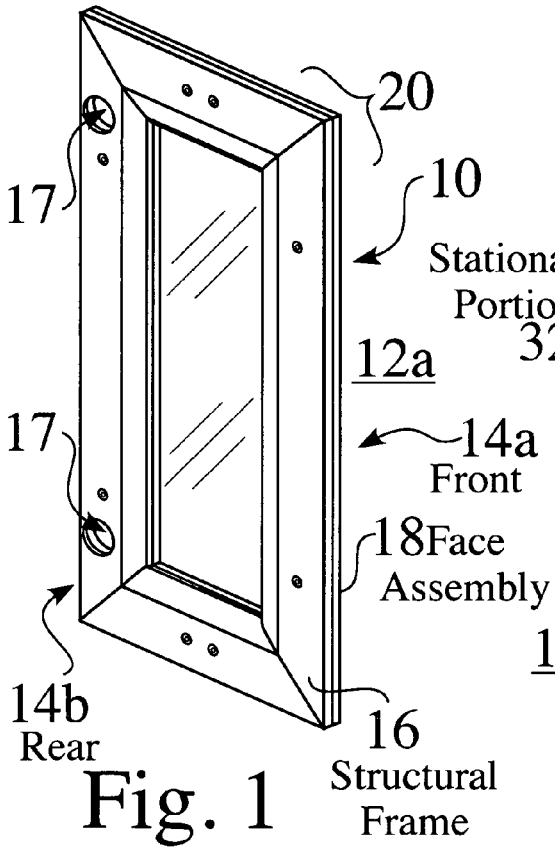
FIG. 1 is a rear perspective view of a framed style embodiment of a modular cabinet assembly.

FIG. 1 is a rear perspective view 10 of a framed, style modular cabinet assembly 12*a*. In the cabinet assembly 12*a* shown in FIG. 1, a structural frame 16 is preferably located on the rear, i.e. inner side 14*b* of the cabinet 12*a*.

Figures 32, 33:
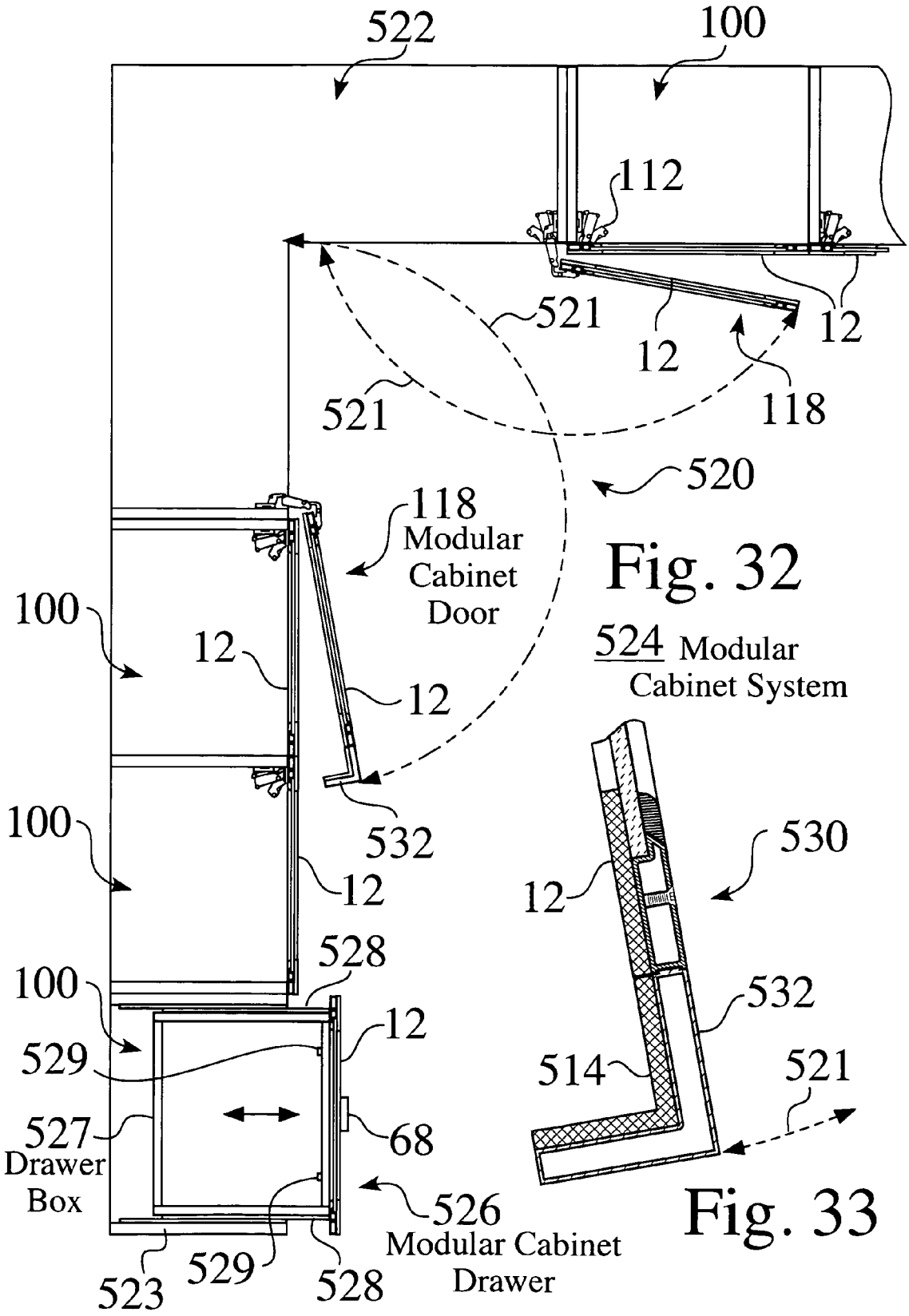
FIG. 32 is a plan view of a corner cabinet with a corner door extension in place, attached to a left hand side door within a kitchen environment.
FIG. 33 is a detailed top cutaway view of a corner door extension attached to a left hand side modular door.

The structural frame 16 fixedly retains a front cabinet face structure, i.e. a skin assembly 18, and also preferably comprises means 17 for attaching the cabinet assembly, such as to a cabinet carcass 100 (e.g. FIG. 6, FIG. 7, FIG. 32), or to a drawer box 527 (FIG. 32).

In a framed style modular cabinet assembly 12*a*, the face structure 18*a* comprises a perimeter frame 20 (FIG. 1, FIG. 4), and a central inset panel 44, which can easily be matched to numerous designs, such as but not limited to traditional or shaker style kitchens. The frame 20 and panel 44 can be the same material, e.g. wood, or the inset panel 44 can be a complementary material to the frame 20, e.g. such as a glass, metal, or lacquer panel 44 surrounded by a wood frame 20. The framed style modular cabinet assembly 12*a* is readily integrated into a large number of existing and new modular cabinet systems 524 (FIG. 32), since framed door styles are often chosen for residential applications, e.g. kitchens, particularly in the United States, wherein a large portion of mid-range residential kitchens are built with a framed door style.

In some modular cabinet embodiments 12*a*, the frame 20 of the face assembly 18*a* substantially covers the structural frame 16, such that the structural frame 16 is not readily seen by as user when a cabinet door 118 (FIG. 7) or drawer 526 (FIG. 32) is in a closed position in relation to a modular cabinet system 524.

Figure 2:
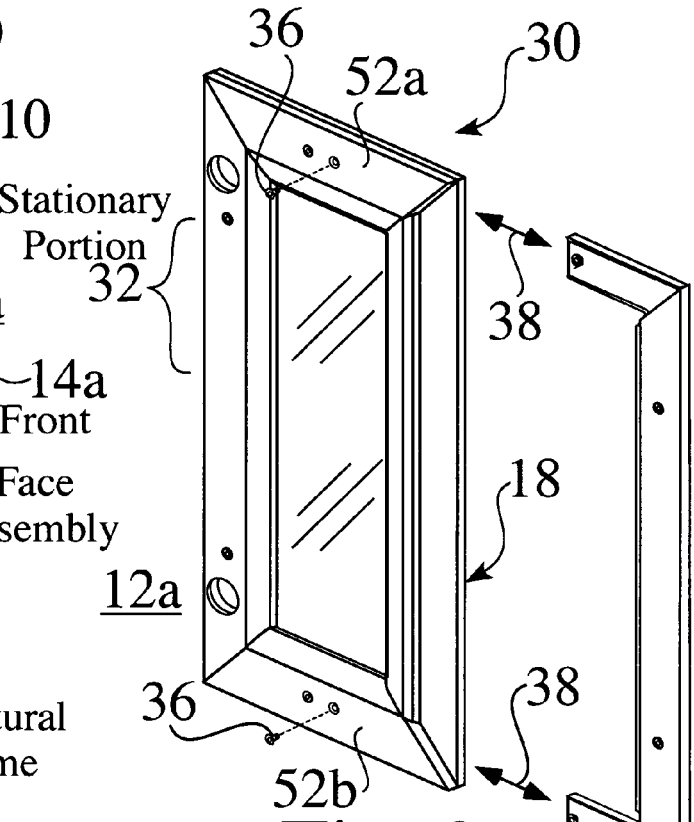
FIG. 2 shows removal and/or attachment of a portion of a structural frame in a framed style embodiment of a modular cabinet assembly.

FIG. 2 shows removal and/or attachment 30 of a portion 34 of a structural frame 16 in a framed style modular cabinet assembly 12*a*. A removable portion 34 of the frame 16 is detachable from the frame 16, such as by detachment of fasteners 36, and by a slidable release 38 of the removable portion 34 from the remaining, i.e. stationary portion 32 of the structural frame 16.

Figure 3:
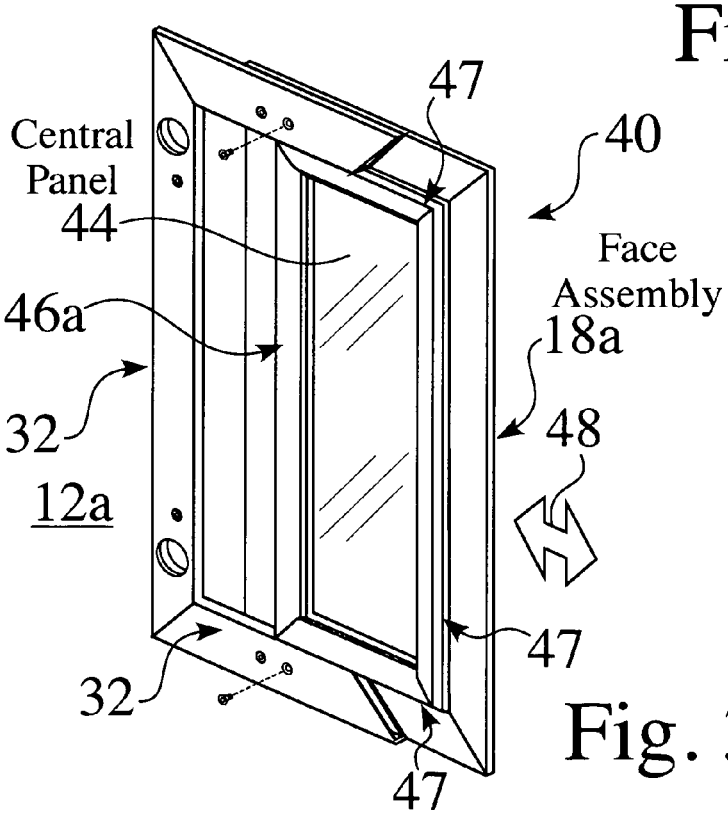
FIG. 3 shows removal and/or replacement of an outer skin assembly in a framed style embodiment of a modular cabinet assembly.

FIG. 3 shows removal and/or replacement 40 of an outer face assembly 18*a* in a framed style modular cabinet assembly 12*a*. In the preferred modular assembly 12*a* shown in FIG. 2 and FIG. 3, the face structure 18 further comprises a retaining assembly 46, such as comprising grooved elastomer members 64,66 (FIG. 4), which retains the face structure 18 to the structural frame 16 when the frame is in an assembled position 20 (FIG. 1). Upon removal 38 of a portion 34 of the structural frame 16, as seen in FIG. 2, the retaining assembly 46 is releasably movable 48 in relation to the remaining portion 32 of the structural frame 16.

As seen in FIG. 3, a significant advantage of modular cabinet assemblies 12, such as the framed style modular cabinet assembly 12*a*, is that the face structure 18, e.g. 18*a*, is readily removed and replaced 40, such as through the modular cabinet process 300 (FIG. 21), such as to replace one or more modular cabinet assemblies 12*a* with new assemblies having a different design, or even to replace or renovate a single panel.

As seen in FIG. 2 and FIG. 3, for a modular cabinet assembly 12 used as a modular cabinet door 118 (FIG. 7, FIG. 32) or as a modular cabinet drawer 526 (FIG. 32), a portion 32 of the structural frame 16 can remain in place during the modular cabinet process 300, e.g. steps 30,40.

For example, a first portion 32 of a structural frame 16 for a door 118 (FIG. 7), such as is connected to a cabinet carcass 100 (FIG. 7, FIG. 32) via hinges 112 (FIG. 7), can remain in place during the process 300, which eliminates the need to unscrew the hinges 112 from the carcass 100, and significantly reduces potential damage to the carcass 100. A modular cabinet assembly 12 for a door 118 can therefore be placed, renovated or repaired, even at the site of the installed cabinet 118, i.e. in the field, without the removal of the stationary portion 32 of the structural frame from the hinges 112 or cabinet carcass, i.e. base 100.

For a modular cabinet assembly 12 used as a modular drawer 526, the structural frame 16 is typically mechanically affixed 529 to a drawer box 527, such as between the drawer box 527 and one or both horizontal frames 52*a*,52*b*. For a modular drawer 526, the first portion 32 can similarly remain in place during the process 300, which eliminates the need to unfasten 529 the structural frame 16 from the drawer box 527, and similarly reduces potential damage to the drawer box 527. A face assembly 18 for a modular cabinet drawer 526 can therefore be placed, renovated or repaired, even at the site of the installed drawer 526, i.e. in the field, without the removal of the stationary portion 32 of the frame from the drawer box 527, and without removing the drawer box 527 from the drawer glides 528 (FIG. 32).

As seen in FIG. 2 and FIG. 3, when one side of the structural frame 16 of the assembly 12 is removed, such by unscrewing two anchor screws 36, the front face assembly 18 is removed, and a new, repaired, or renovated panel 18 similarly inserted.

Figure 4:
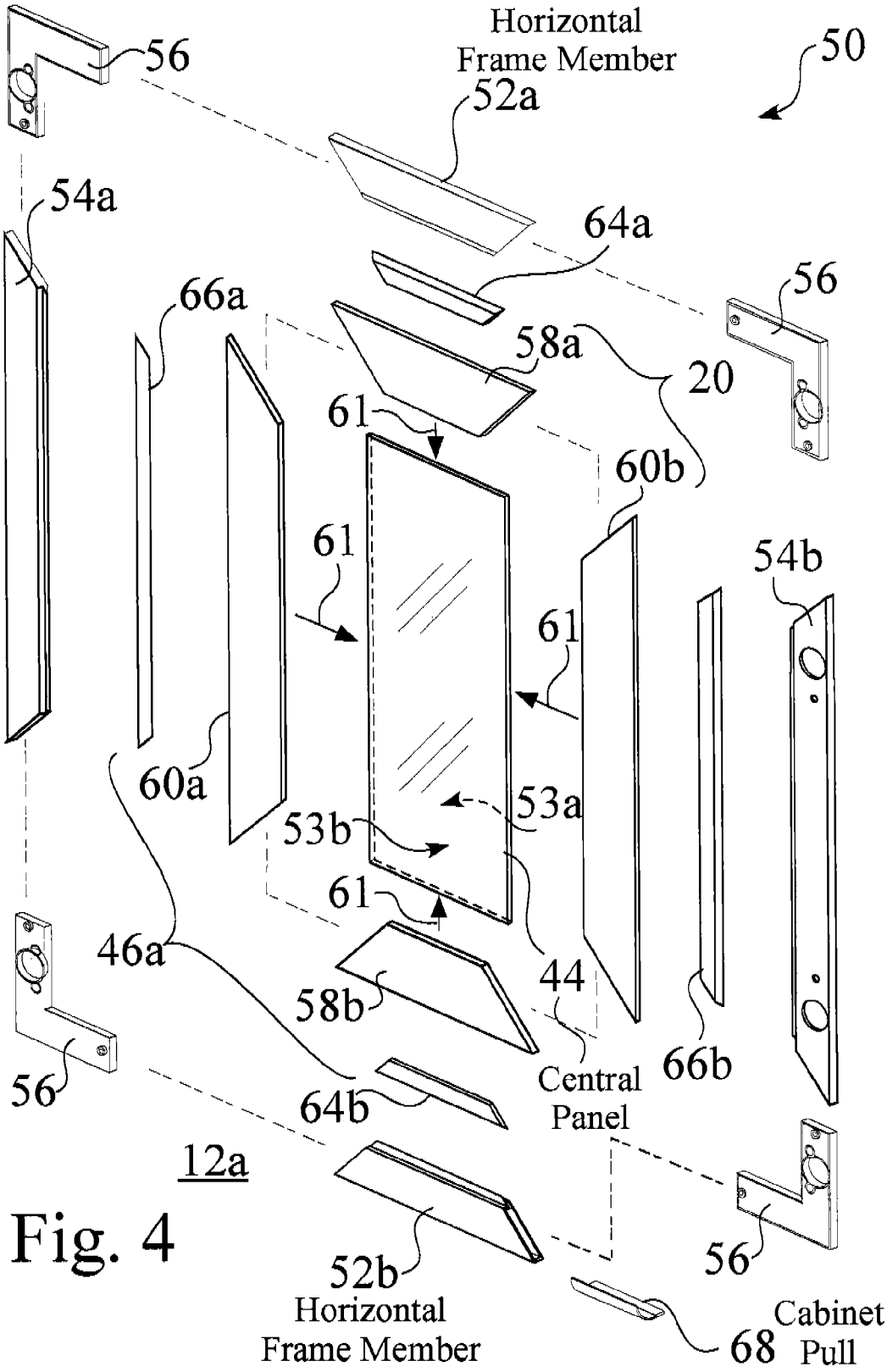
FIG. 4 is an exploded assembly view of a full door assembly for a framed door style embodiment of a modular cabinet assembly.

In some preferred embodiments of the modular cabinet system 12, the structural frame 16 is comprised of frame members 52, 54, e.g. 52*a*,52*b*,54*a*,54*b* (FIG. 4), comprised of an extruded metal, e.g. aluminum, structure 70 (FIG. 5), which are fastened together through brackets 56 (FIG. 4).

In preferred embodiments of the framed style modular cabinet assembly 12*a* in FIG. 2, the fasteners 36 which require removal for frame disassembly 30 are inset into the aluminum frame 52*a*,52*b*, and can be used to perform repeated changes 30, without any significant depreciation of quality of the structural frame 16. As such, the face assembly 18 is not required to be attached directly to either the fasteners 36 or to hinges 112 or other hardware 68 (FIG. 22), which protects the cabinet face 18 for potential damage though use and/or service.

FIG. 4 is an exploded assembly view of a full door assembly for a framed door style modular cabinet assembly 12*a*. An outer frame 20 of a face assembly 18 is comprised two horizontal frame members 58*a*,58*b*, and two vertical frame members 60*a*,60*b*. The outer frame 20 is fixedly attached 62 to a central panel 44, such as but not limited to an adhesive layer or by double-stick tape 61 (FIG. 11), between the outer frame 20 and the first surface 53*a* of the central panel 44.

A retaining assembly 46, such as comprising elastomer members 64*a*, 64*b*, 66*a*,66*b*, is also fixedly attached 62 to the central panel 44, such as but not limited to an adhesive layer or by double-stick tape 63 (FIG. 11) between the retaining assembly 46 and the second surface 53*b* of the central panel 44.

The structural frame 16 shown in FIG. 4 is comprised of horizontal frame members 52*a*,52*b* and vertical frame members 54*a*,54*b*, preferably fabricated from an extruded metal, e.g. aluminum, structure 70, which are fastened 36 together through brackets 56 (FIG. 4).

As seen in FIG. 4, for framed assemblies 12*a* used for cabinet doors, some preferred embodiments of the inner vertical frame member 54*b* comprise hinge access holes defined into the member 54*b*, which provide improved compatibility with a wide variety of hinge hardware 112.

Figure 5:
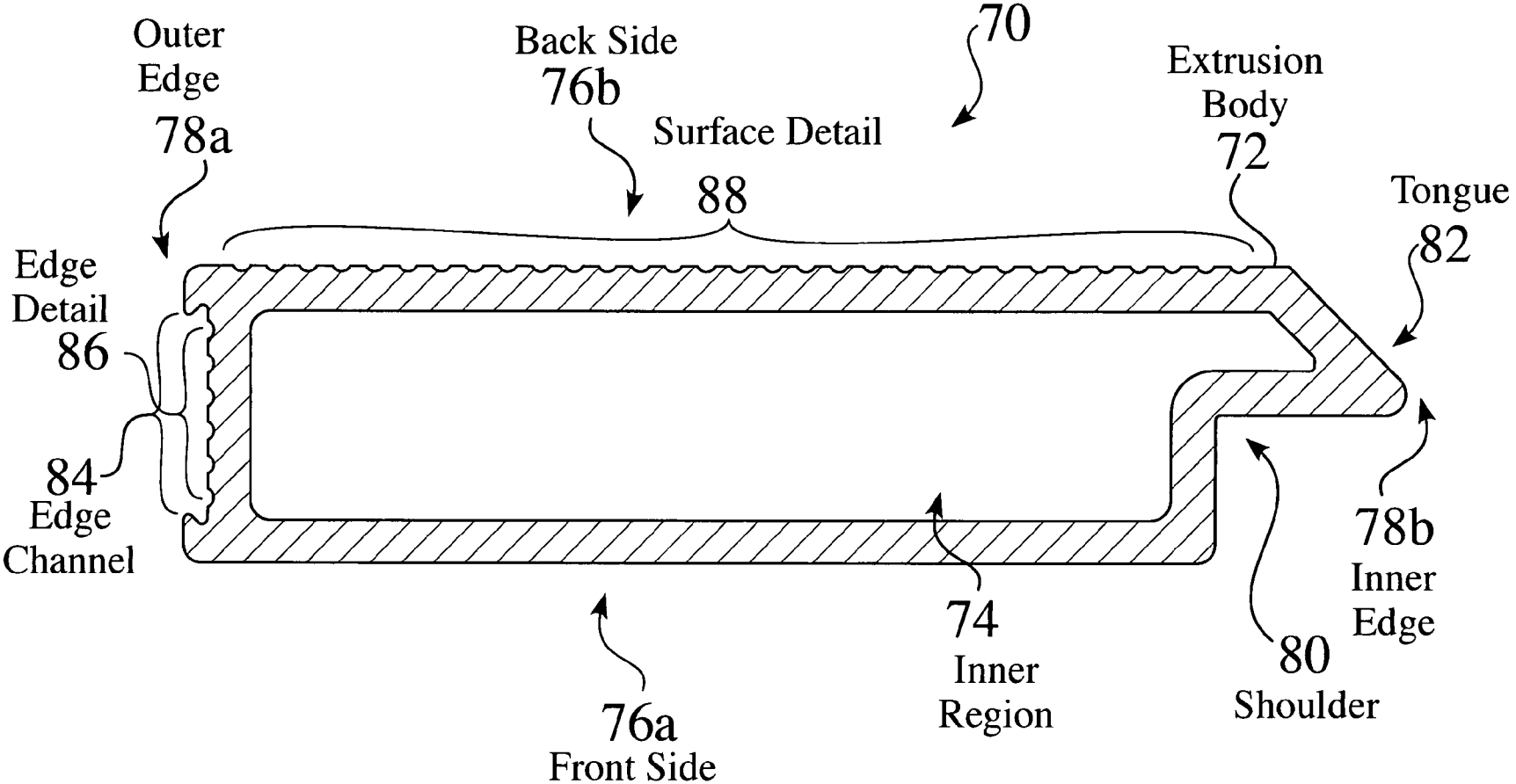
FIG. 5 is side cross sectional view of a frame extrusion.

FIG. 5 is side cross sectional view of a preferred frame extrusion 70, from which frame members 52,54 for preferred embodiments of the structural frame are readily fabricated. The extrusion 70 preferably comprises a metal structure 72, having a front side 76*a*, a back side 76*b*, an outer edge 78*a*, and an inner edge 78*b*. The extrusion 70 preferably comprises an inner region 74 defined therethrough, which provides room for brackets 56, and provides sufficient mechanical strength for the assembly 16, while reducing mass and inertia for cabinet structures 12.

A channel 84 is preferably defined along the outer edge 78*a*, which provides access for slidably installed, confined, and/or affixed connections to other structures, such as for handles 68 (FIG. 4, FIG. 22, 23), filler trim 346 (FIG. 22), corner fillers 432, 542 (FIG. 32-37).

The interior edge 78*b* of the frame extrusion 70 preferably comprises a shoulder 80 defined thereon, which corresponds to outer edge of the central panel 44 for the framed cabinet assembly 12*a*. The interior edge also preferably comprises a tongue 82 which extends from the shoulder 80, which corresponds to a housing channel 47 (FIG. 3, FIG. 11) formed between the retaining assembly 46 and the central panel 44. While one exemplary embodiment of the shape of the tongue 82 and corresponding housing channel 47 is shown in FIG. 5, the tongue 82 and corresponding housing channel 47 may alternately comprise a variety of shapes which provide a tongue and groove relationship between the structural frame 16 and the face frame 18, which fixedly attaches the assemblies 16,18, when the frame is closed, and provides slidable movement between the assemblies when one 34 of the frame members 52,54 is removed.

For a retaining assembly 46 comprised of elastomer extrusions 64,66, the formed housing channel provides a flexible retaining system (FRS), which readily provides easy slidable removal and/or installation of face assemblies 18 within a structural frame 16, and provides a secure and dampened connection 20 between the structural frame 16 and the face frame 18 when the structural frame 16 is closed.

Figure 6:
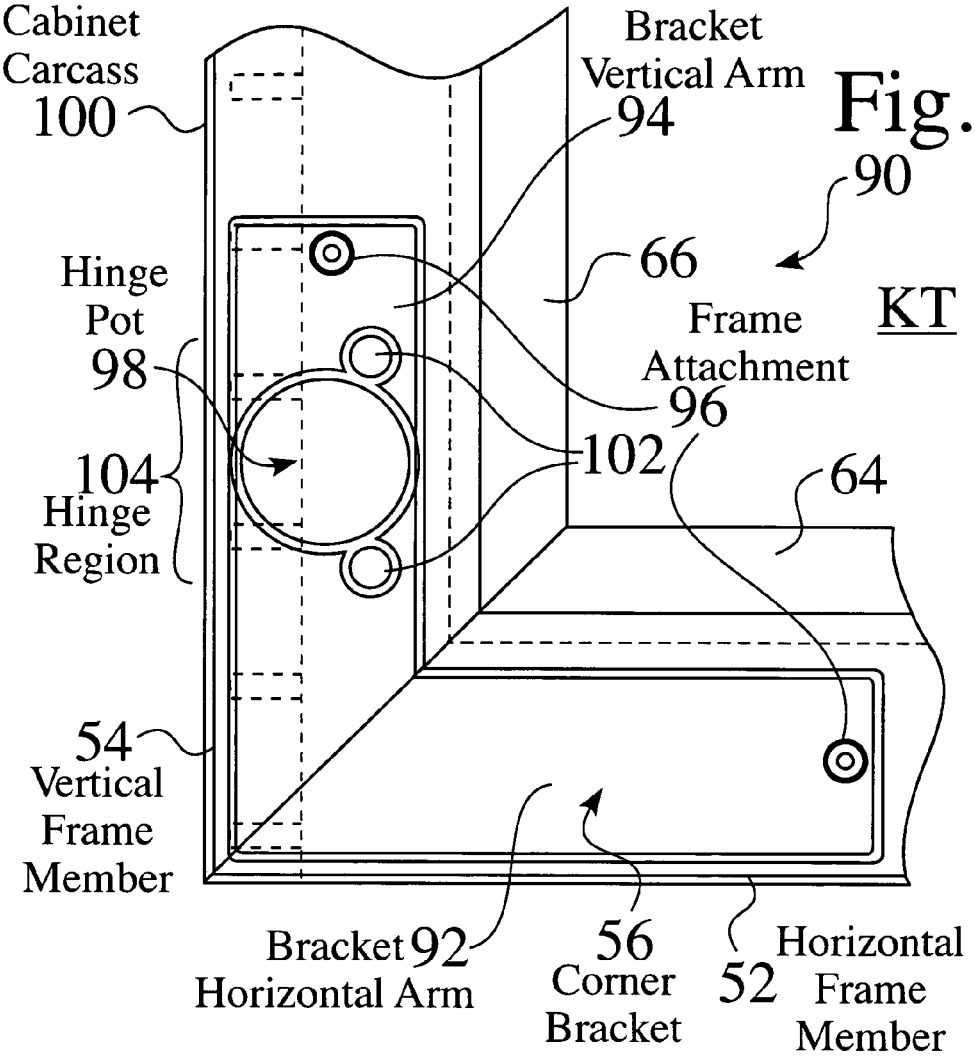
FIG. 6 is a front cutaway view of a corner region of an installed framed door style embodiment of a modular cabinet assembly.
Figure 7:
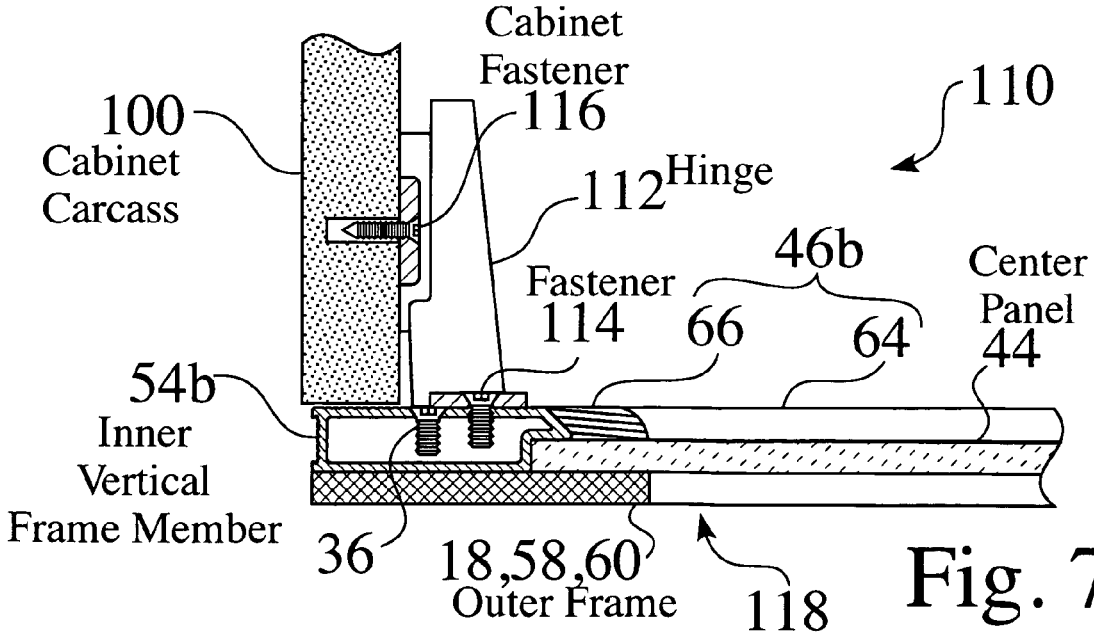
FIG. 7 is a top cutaway view of an installed framed door style embodiment of a modular cabinet assembly.

FIG. 6 is a front cutaway view of a corner region 90 of an modular cabinet assembly 12 installed as a modular cabinet door 118 within a modular cabinet system 524 for a kitchen KT. FIG. 7 is a top cutaway view 110 of an installed framed door style modular cabinet assembly 12*a*. The corner bracket 56 comprises a horizontal bracket arm 92 and a vertical bracket arm 94, which extend into the inner region 74 of the preferred extruded frame members 52,54. As the corner brackets 56 are preferably located within the hollow region 74 of the members 52,54, the corner brackets 56 are hidden within the structure shown in FIG. 6.

Although conventional brackets are often used to connect corners in frame applications, the modular cabinet bracket 56 is preferably unique in its size relative to the overall frame 16, wherein the bracket 56 extends 92,94 much further into the adjacent frame sides. For example, the vertical arm 94 preferably extends well into the vertical frame member 54, and comprises a hinge pot 98 defined therein, as well as hinge fastener holes 102. Embodiments of the modular assembly 12 that comprise vertical bracket arms 94 which extend into the hinge region 104 and include the hinge fastener holes 102 provide enhanced stability and durability to the overall frame 16.

Figure 8:
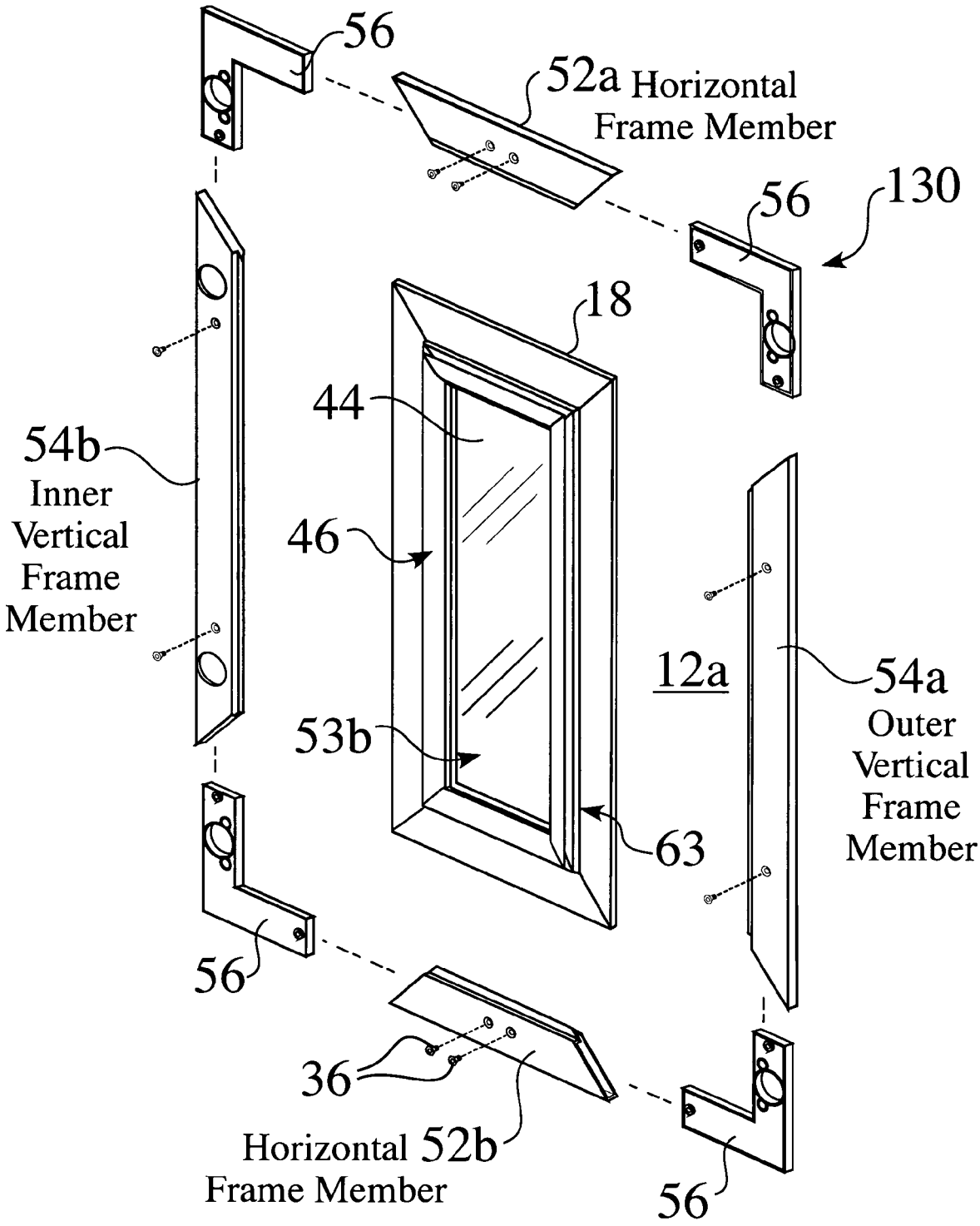
FIG. 8 is an expanded assembly view of a framed outer structure and an assembled outer face assembly for a framed style embodiment of a modular cabinet assembly.

FIG. 8 is an expanded assembly view of a framed outer structure 16 and an assembled face structure 18 for a framed style embodiment of a modular cabinet assembly 12*a*. As seen in FIG. 8, the retaining assembly 46, preferably comprising an FRS elastomer extrusion 46 is shown affixed 63 to the back surface 53*b* of the central door or drawer panel 44.

Figure 9:
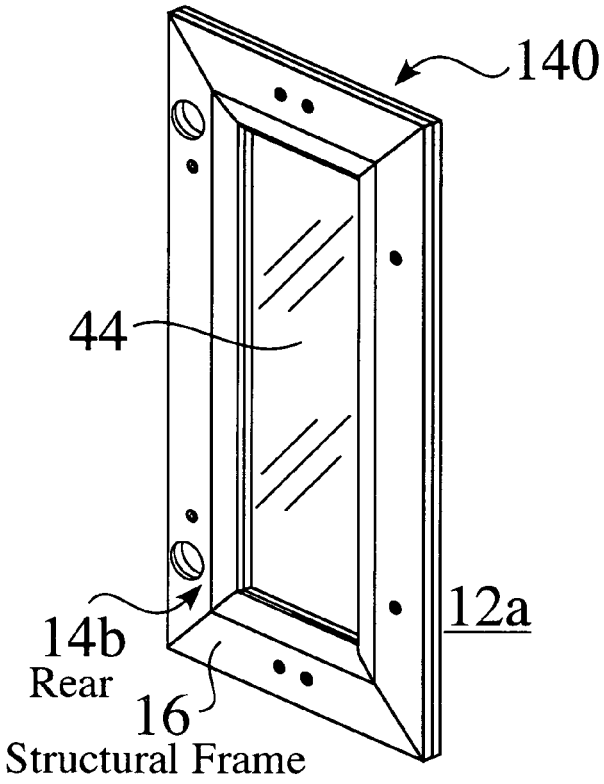
FIG. 9 is a rear perspective view of an assembled framed style embodiment of a modular cabinet assembly.
Figure 10:
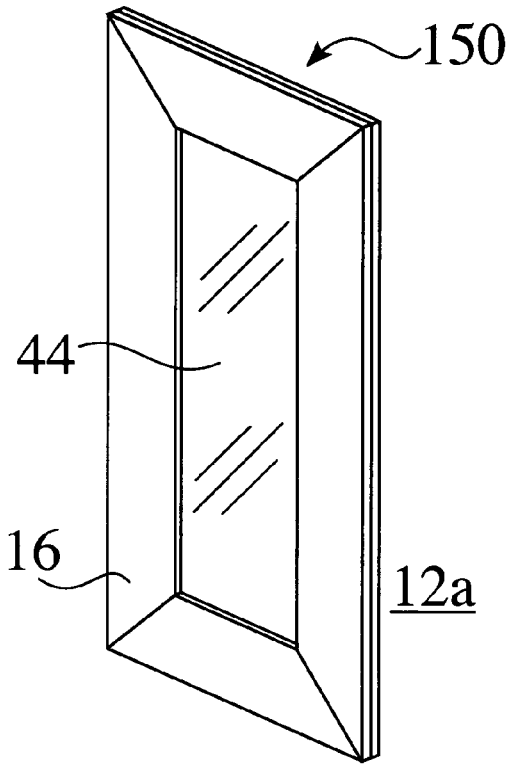
FIG. 10 is a front perspective view of an assembled framed style embodiment of a modular cabinet assembly.
Figure 11:
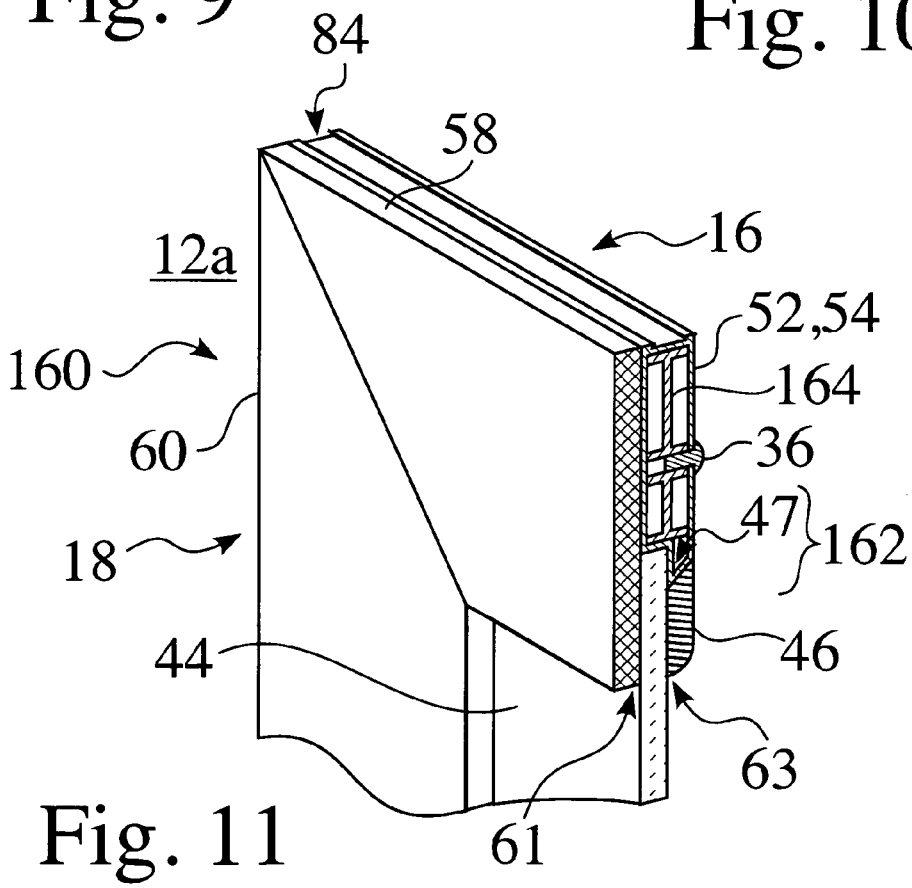
FIG. 11 is a detailed cutaway view of an assembled framed style embodiment of a modular cabinet assembly.

FIG. 9 is a rear perspective view 140 of an assembled framed style modular cabinet assembly 12*a*. FIG. 10 is a front perspective view 150 of an assembled framed style modular cabinet assembly 12*a*. FIG. 11 is a detailed cutaway view 160 of an assembled framed style modular cabinet assembly 12*a*, which shows the relationship between the structural frame assembly 16 and the front face assembly 18*a*, which preferably comprises a tongue and groove relationship 162, such as created between a retaining assembly 46 affixed to the front assembly 18 and a tongue detail incorporated into the structural frame 16.

In the modular assembly 12*a* shown in FIG. 11, the outer frame 20, typically comprising frame members 58,60, is affixed 61 to the central panel 44, such as by but not limited to an adhesive or double-stick tape 61. As well the retaining assembly 46, such as comprising FRS elastomeric extruded members, is affixed to the central panel 44, such as by but not limited to an adhesive or double-stick tape. While some of the preferred embodiments 12 shown are described as adhesive attachments, alternate means for attachment may be used, such as but not limited to mechanical or microwelding attachments.

In the modular assembly 12*a* shown in FIG. 11, the structural frame 16 is typically comprised of frame members 52,54, which are attached together, such as by fasteners 36 and brackets 56, as seen in FIG. 8. Fasteners 36 and 114 can be attached fastened directly to the frame members 52,54 and or brackets 56, as well as to other structures 164 located on or within the frame members 52,54, such as but not limited to extrusions or pre-threaded inserts 164.

Flat Panel Modular Cabinet Structures. While the frame style modular cabinet system 12*a* is preferred for some design environments, full panel designs are also popular, particularly for modern or European design applications. The modular cabinet system 12 provides several full panel embodiments 12, e.g. 12*b*, 12*d* (FIG. 25), which can readily be integrated into a design that requires full panel cabinetry.

Figure 12:
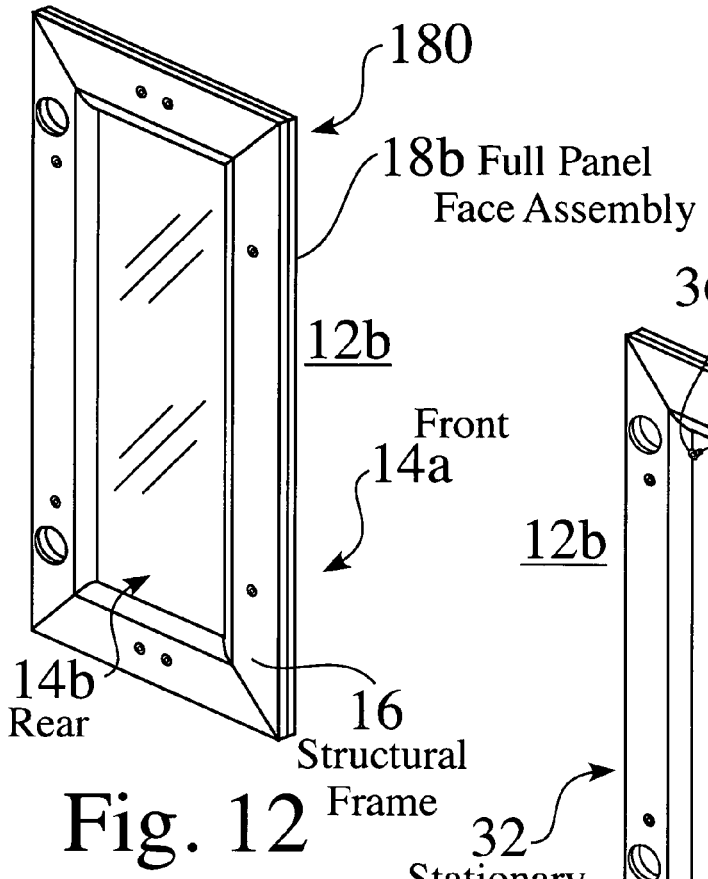
FIG. 12 is a rear perspective view of a full panel style embodiment of a modular cabinet assembly.

FIG. 12 is a rear perspective view 180 of a full panel style modular cabinet assembly 12*b*. In a full panel modular cabinet assembly 12*b*, the face structure 18*b* comprises a full panel 212 across the front of the assembly, which can easily be matched to numerous designs, such as but not limited to contemporary, modern, and European-style kitchens. The full panel 212 is preferably comprised of any of a wide variety of materials, such as but not limited to glass, metal, plastic, wood, stone, fiberglass, carbon fiber, or metal clad core structures. In some embodiments 12*b*, the full panel 212 substantially covers the structural frame 16, such that the structural frame 16 is not readily seen by as user when a cabinet door 118 or drawer 526 is in a closed position in relation to a modular cabinet structure.

Full panel door styles are currently gaining in popularity in the United States, as consumers become more familiar with European styling in cabinetry. The full panel style modular cabinet assembly 12*b* is readily integrated into a large number of existing and new cabinet systems, providing a cohesive fit and feel to such design environments.

While some structural details of full panel style modular cabinets 12*b* are different than structural details of frame style modular cabinets 12*a*, service and replacement processes are typically identical. Some embodiments of the frame structure 16 are used for both frame style modular cabinets 12*a* and full panel style modular cabinets 12*b*, such that many modular cabinet systems 12 can readily be renovated, simply by replacing the face assemblies, to provide a radically different look. For example, a kitchen having light birch frames 18 with frosted glass center panels 44 can readily be changes to full panels 212 having engine-turned stainless steel cladding, without having to remove the structural frames 16 from the cabinet or carcasses 100.

Figure 13:
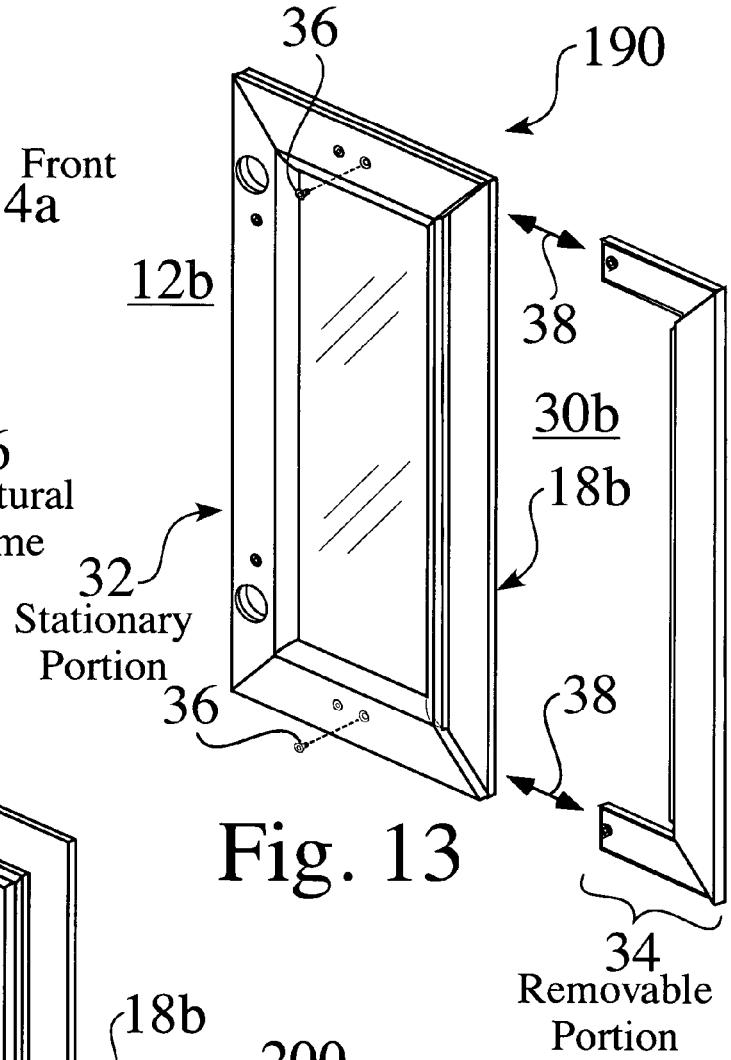
FIG. 13 shows removal and/or attachment of a portion of a structural frame in a full panel style embodiment of a modular cabinet assembly.
Figure 14:
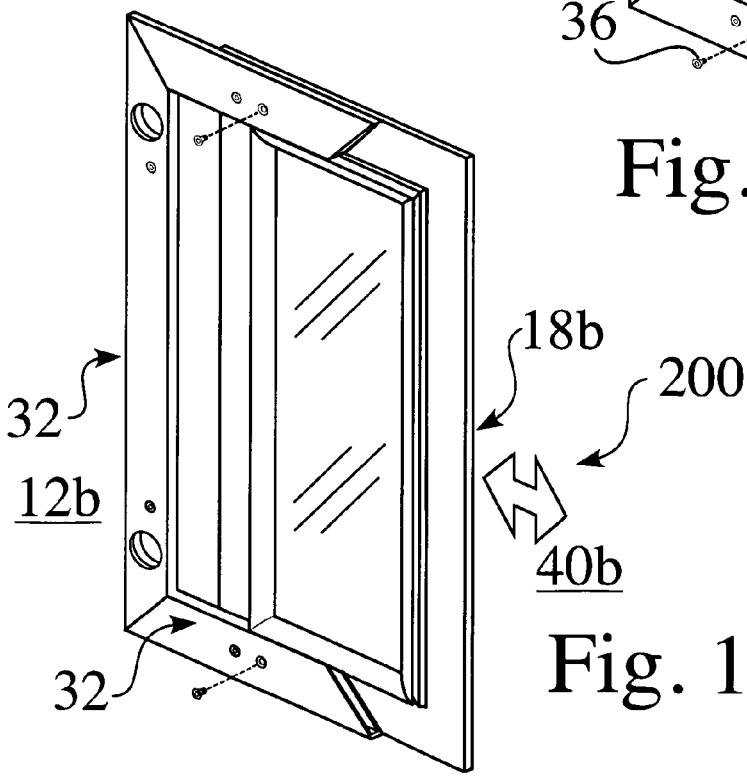
FIG. 14 shows removal and/or replacement of an outer skin assembly in a full panel style embodiment of a modular cabinet assembly.

FIG. 13 shows 190 removal and/or attachment of a portion of a structural frame 16 in a full panel style modular cabinet assembly 12*b*. FIG. 14 shows 200 removal and/or replacement of an outer skin assembly 18*b* in a full panel style modular cabinet assembly 12*b*.

In the full panel style modular cabinet assembly 12*b*, the retaining assembly 46, such as comprising FRS elastomeric extruded members 64,66, is directly affixed 63 to the front panel 212, such as by but not limited to an adhesive 63 or double-stick tape 63. While some of the preferred embodiments 12 shown are described as adhesive attachments, alternate means for attachment may be used, such as but not limited to mechanical or microwelding attachments.

Figure 15:
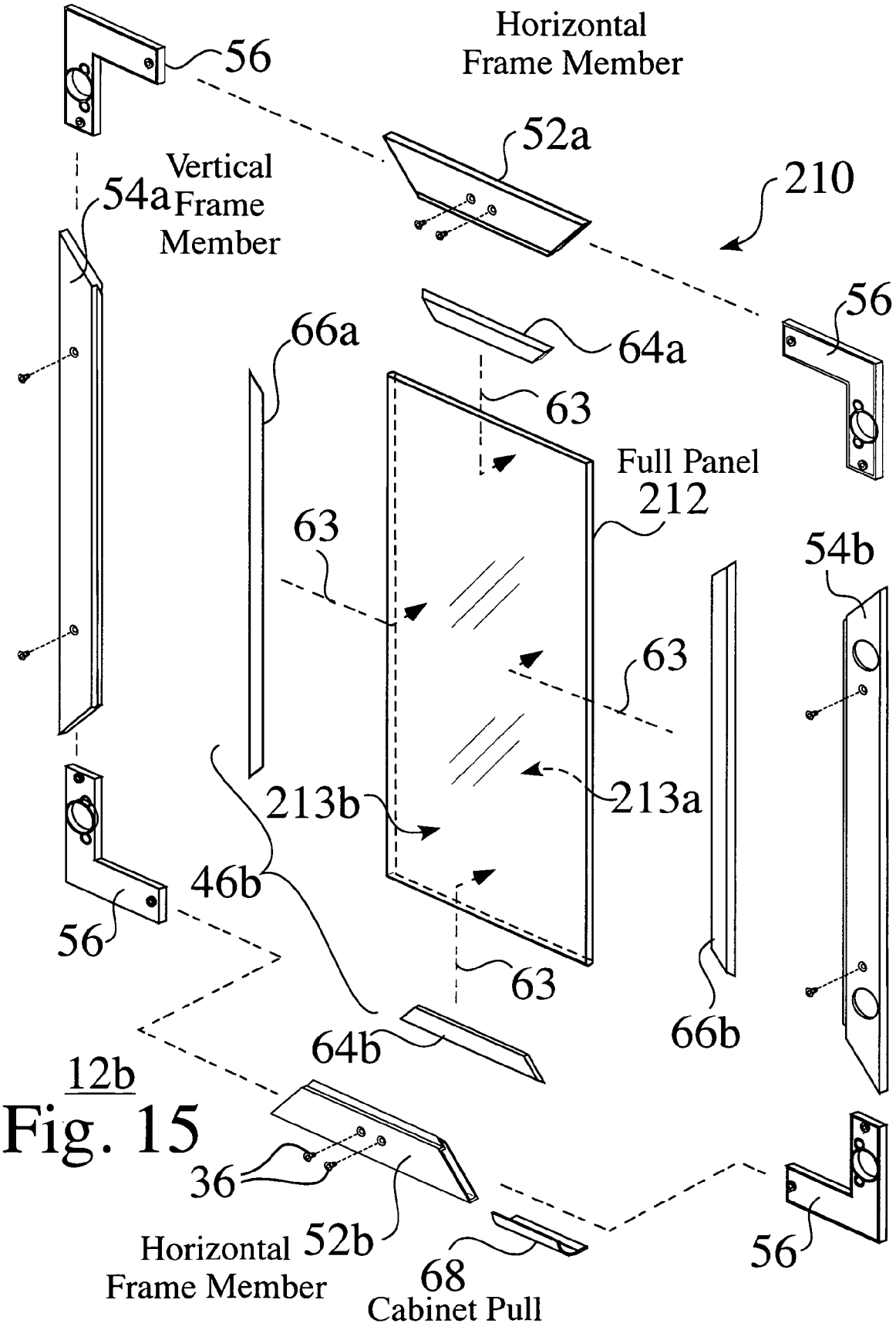
FIG. 15 is an exploded assembly view of a full panel door style modular cabinet assembly.

FIG. 15 is an expanded assembly view for a full panel door modular cabinet assembly 12*b*. A full panel 212, having a front surface 213*a* and an opposing rear surface 213*b*, is fixedly attached 63 directly to a retaining assembly 46, such as comprising elastomer members 64*a*,64*b*,66*a*,66*b*, such as by but not limited to an adhesive layer 63 or double-stick tape 63 (FIG. 20) between the retaining assembly 46 and the back surface 213*b* of the full panel 212.

While the exemplary retaining assemblies 46*a*,46*b* shown in FIG. 4 and FIG. 15 respectively as separate extruded members 64*a*,64*b*,66*a*,66*b*, the retaining assemblies 46*a*, 46*b* may alternately comprise other retaining structures 46, such as but not limited to a molded structure 46, preferably comprising an elastomer, to preferably provide a dimensionally tolerant, compliant, rattle-free, sound deadening, and/or dampened connection between a frame structure 16 and a face assembly 18.

The structural frame 16 shown in FIG. 15 is typically comprised identically to the structural frame 16 within a framed style modular assembly, i.e. the frame 16 is comprised of horizontal frame members 52*a*,52*b* and vertical frame members 54*a*,54*b*, preferably fabricated from an extruded metal, e.g. aluminum, structure 70, which are fastened 36 together through brackets 56.

Figure 16:
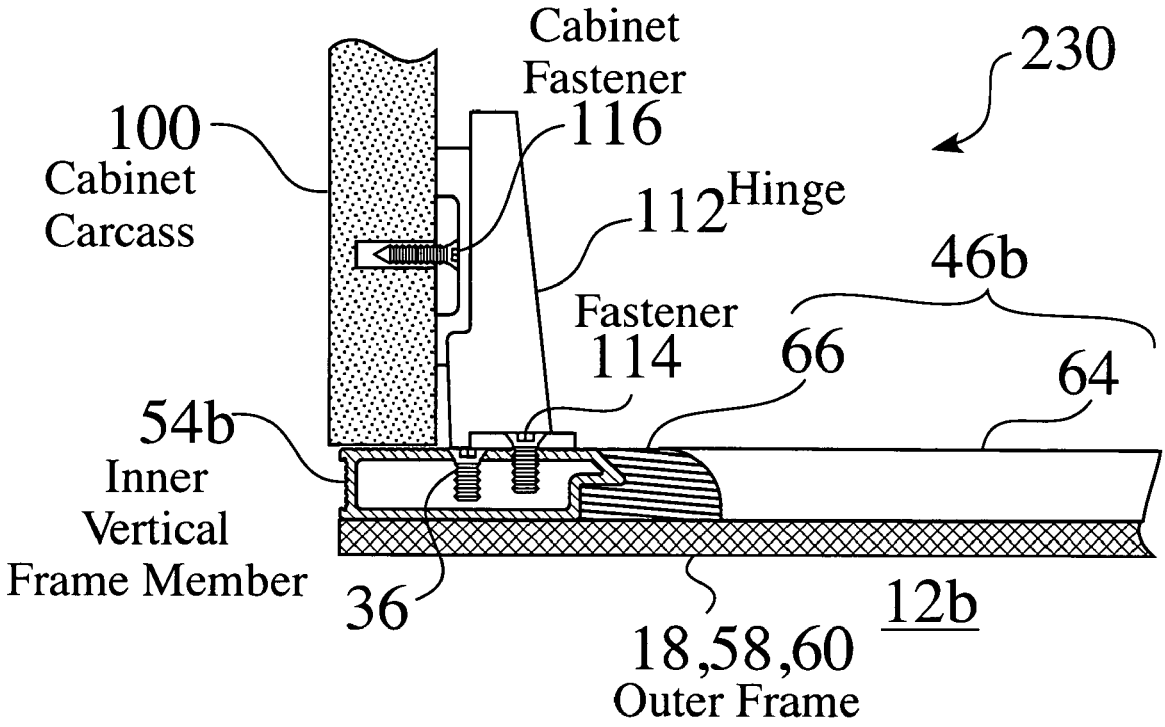
FIG. 16 is a top cutaway view of an installed pull panel door modular cabinet assembly.

FIG. 16 is a top cutaway view 230 of an installed full panel door modular cabinet assembly 12*b*. While the frame structure 16 is preferably identical between frame panel modular assemblies 12*a* and full panel modular assemblies 12*b*, the structural details of the front face assembly 18*b* do not require a central panel 44. As seen in FIG. 16, the retaining assembly 46*b*, which preferably comprises FRS elastomeric extruded members 64,66, is directly affixed 63 to the front panel 212, and provides and extends around the tongue 82 and into the shoulder 80 of the frame members, to provide a tongue and groove relationship between the structural frame 16 and the face frame 18, which fixedly attaches the assemblies 16,18, when the frame is closed, and provides slidable movement between the assemblies when one 34 of the frame members 52,54 is removed.

Figure 17:
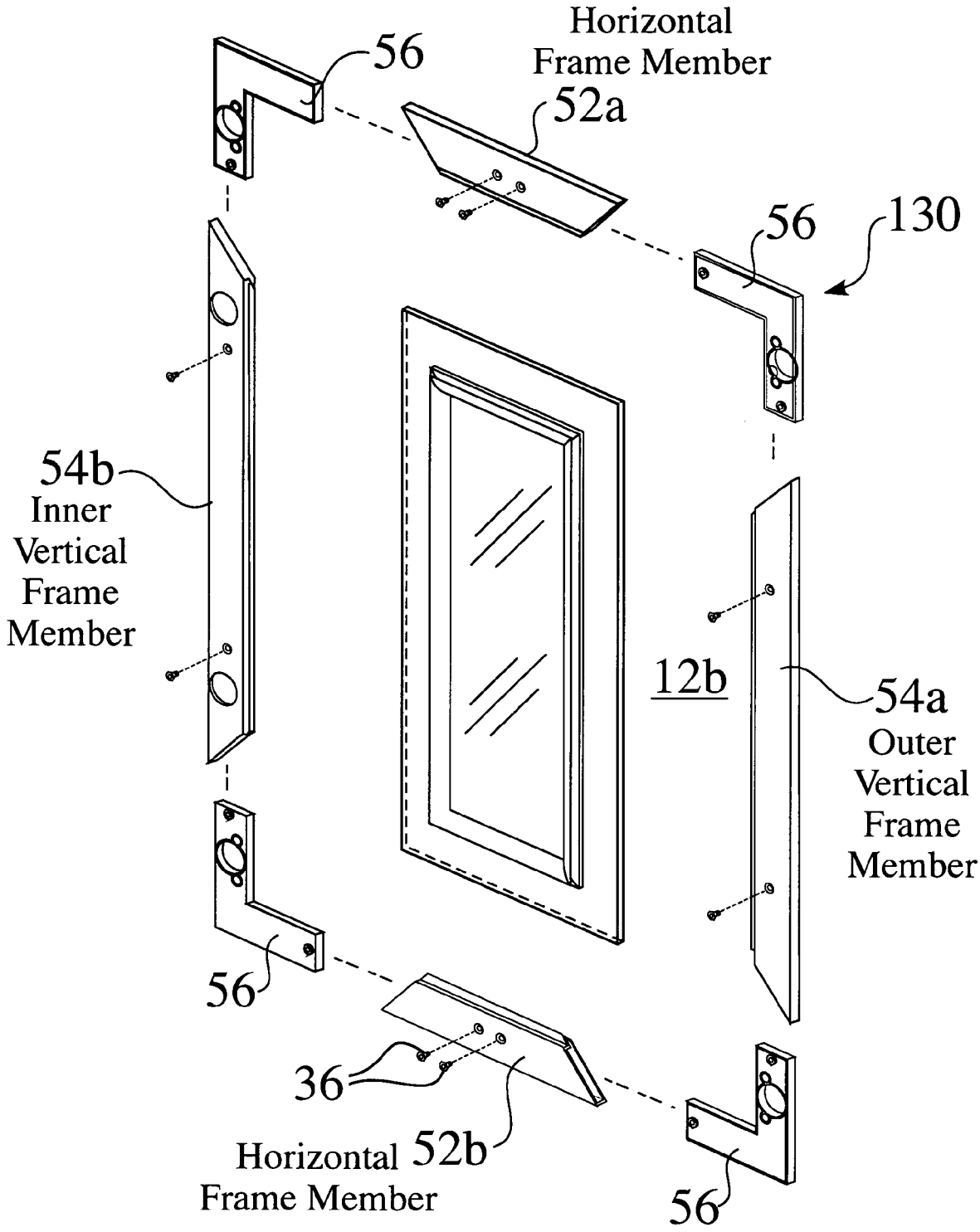
FIG. 17 is an expanded assembly view of a frame structure and an assembled outer face assembly for a full panel style modular cabinet assembly.

FIG. 17 is an expanded assembly view 130 of a framed outer structure 16 and an assembled outer face structure 18*b* for a full panel style modular cabinet assembly 12*b*. As seen in FIG. 17, the retaining assembly 46*b*, preferably comprising an FRS elastomer extrusion 46, is shown affixed 63 to the back surface 213*b* of the full door or drawer panel 212.

The initial assembly of the modular structural frame 16 shown in FIG. 17 may be performed in any almost any order, such as around a face assembly 18, or such as seen in FIG. 13, wherein a U-shaped structure 32 and a second structure are assembled first, and wherein a face assembly 18 is slidably installed 48 into the U-shaped structure 32, followed by positioning 38 and attachment 36 of the second structure 34.

Figure 18:
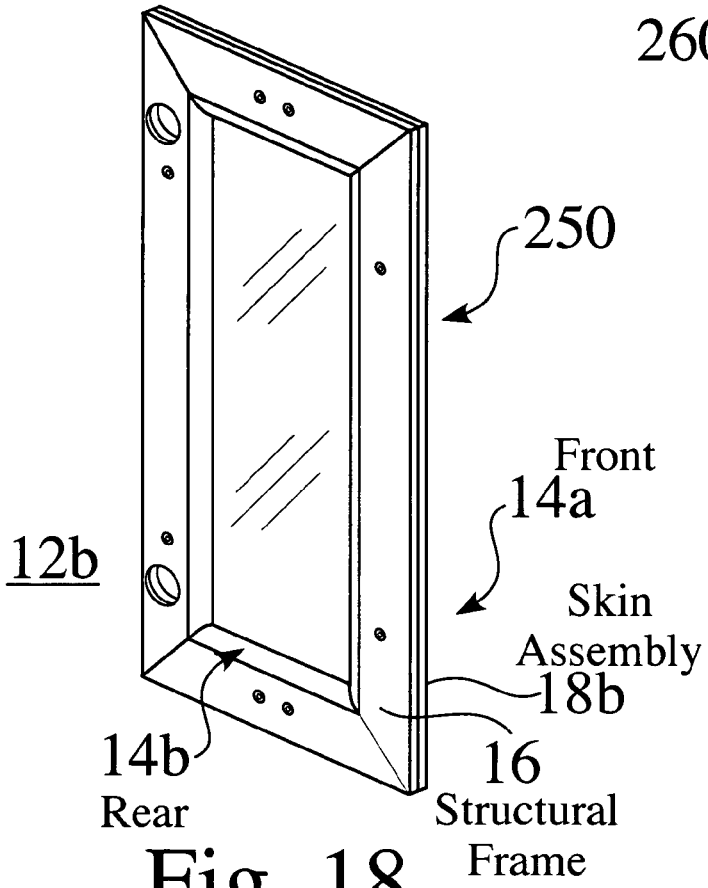
FIG. 18 is a rear perspective view of an assembled full panel style embodiment of a modular cabinet assembly.
Figure 19:
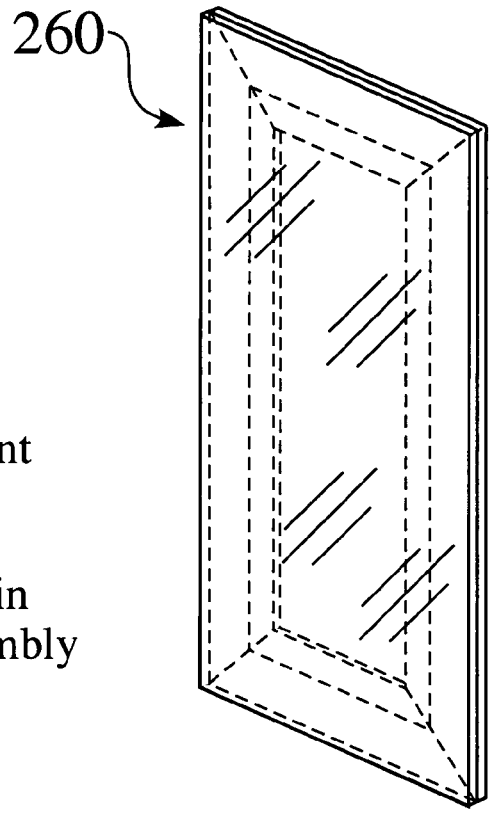
FIG. 19 is a front perspective view of an assembled full panel style embodiment of a modular cabinet assembly.
Figure 20:
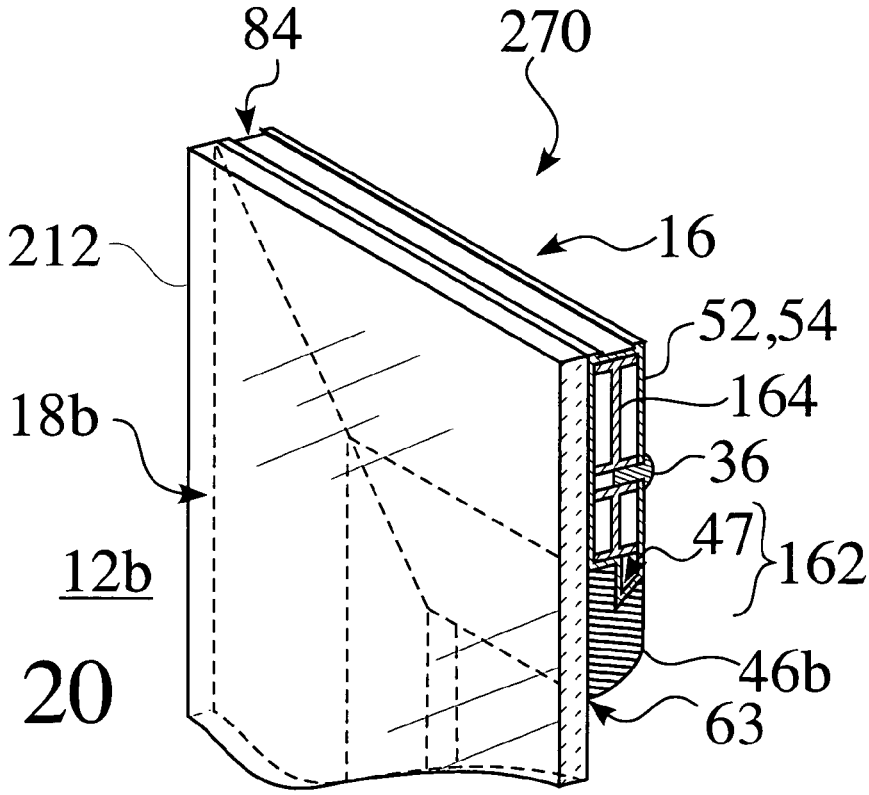
FIG. 20 is a detailed cutaway view of an assembled full panel style embodiment of a modular cabinet assembly.

FIG. 18 is a rear perspective view 250 of an assembled full panel modular cabinet assembly 12*b*. FIG. 19 is a front perspective view 260 of an assembled full panel style modular cabinet assembly 12*b*. FIG. 20 is a detailed cutaway view 270 of an assembled full panel style modular cabinet assembly 12*b*, which shows the relationship between the structural frame assembly 16 and the front face assembly 18*b*.

The structural frame 16 and the face structure 18*b* preferably comprise a tongue and groove relationship 162, such as provided by a retaining assembly 46*b* affixed to the full panel 212, and a tongue 82 incorporated into the structural frame 16.

In contrast to the retaining assembly 46*a* used in the frame style modular assembly 12*a* shown in FIG. 11, the retaining assembly 46*b* used in the frame style modular assembly 12*b* shown in FIG. 20 extends through the shoulder region 80 of the structural frame, and typically provides a defined groove 47, which corresponds to the tongue 82 incorporated into the structural frame 16.

The retaining assembly 46*b*, such as comprising FRS elastomeric extruded members 64,66, is affixed 63 to the full panel 212, such as by but not limited to an adhesive or double-stick tape. While some of the preferred embodiments

12*b* are shown are described as adhesive attachments 63, alternate means for attachment may be used, such as but not limited to mechanical or microwelding attachments.

In the modular assembly 12*b* shown in FIG. 20, the structural frame 16 is typically comprised of frame members 52,54, which are attached together, such as by fasteners 36 and brackets 56, as seen in FIG. 17. Fasteners 36 and 114 can be attached fastened directly to the frame members 52,54 and or brackets 56, as well as to other structures 164 located on or within the frame members 52,54, such as but not limited to extrusions or pre-threaded inserts 164.

Figure 21:
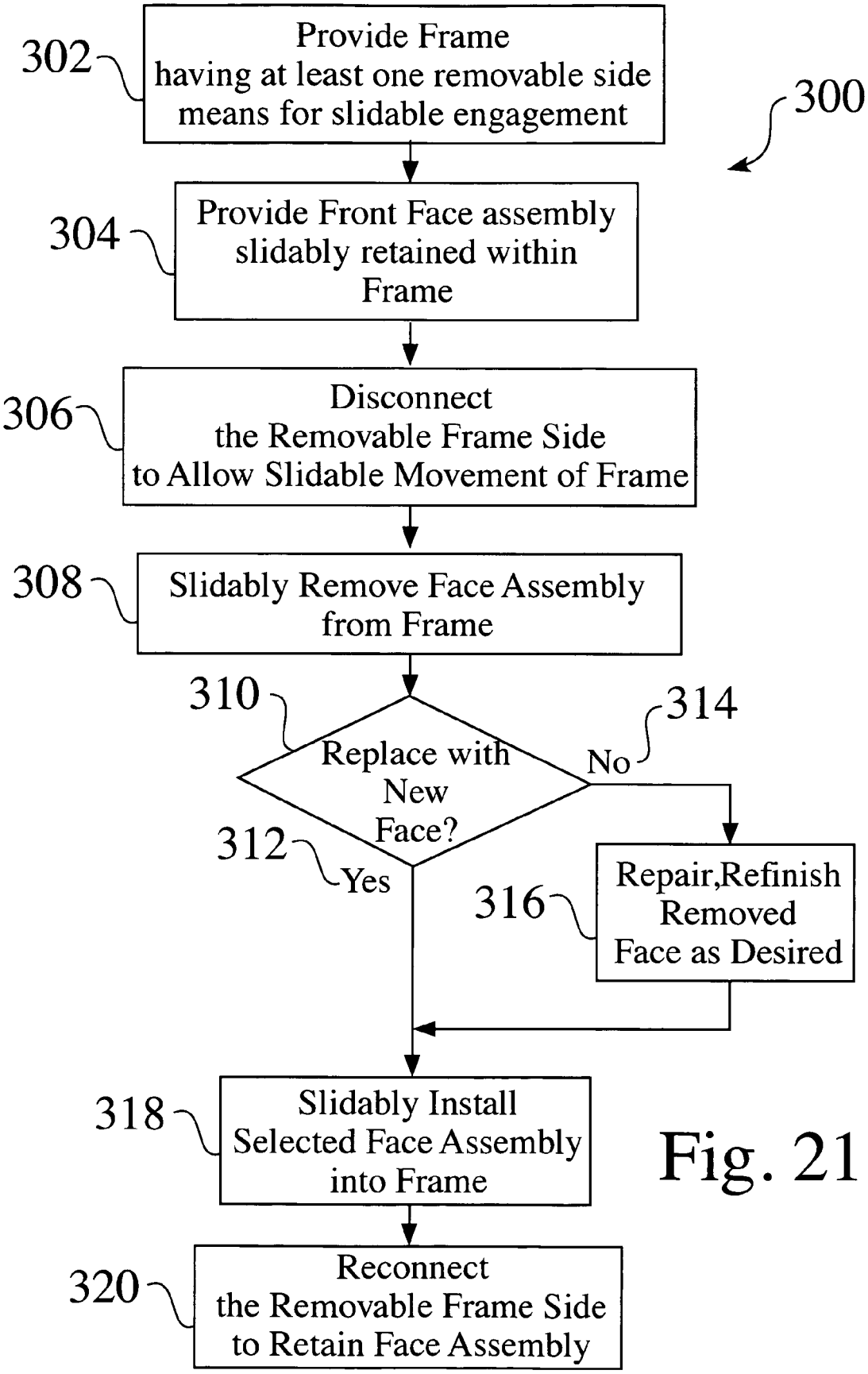
FIG. 21 is a flowchart of a process for providing and/or renovating a modular cabinet assembly.

Modular Cabinet System Process. FIG. 21 is a flowchart of a process 300 for providing and/or renovating a modular cabinet assembly 12, such for a modular cabinet door 12 or modular cabinet drawer 12.

As described above, the modular cabinet structure 12 comprises 302 a frame structure 16, and a face structure 18, 304 having a retaining assembly 46, such as comprising grooved elastomer members 64,66 (FIG. 4), which retains the face structure 18 to the structural frame 16 when the frame is in an assembled position 20, and is releasably movable, such as by sliding, upon removal 30 of a portion 34 of the structural frame 16.

For example, a user can disconnect 306 a removable portion 34 of the structural 16, to provide access to the face assembly 18. The face assembly 18 is then preferably slidably removed 308 from the structural frame 16.

If a decision 310 is made 312 to replace the removed face assembly 18 with an alternate, i.e. new assembly, the user can simply proceed to slidably install 318 the new face assembly 18 into the structural frame 16, and reconnect 320 the removed portion 34 of the structural frame 16, to retain the face assembly 18.

If a decision 310 is made 314 to inspect, repair, renovate, and/or clean and install the removed face assembly 18, the user can simply proceed to slidably reinstall 318 the prior face assembly 18 into the structural frame 16, and reconnect 320 the removed portion 34 of the structural frame 16, to retain the face assembly 18.

As described above, for a modular cabinet assembly 12 used as a door 12, an installed structural frame 16 may typically remain in place on the installed hinges 112 during the process for removing and installing a face assembly. Similarly, for a modular cabinet assembly 12 used as a drawer 118, while an installed structural frame 16 is typically mechanically affixed to a drawer box 527, such as by screws, e.g. 114 (FIG. 7), a portion 34 of the structural frame is removable in situ, allowing a user to readily remove and replace modular cabinet drawer faces 18.

Modular Cabinet Face Structure Options. As described above, the modular cabinet structures 12 inherently provide the ability to quickly remove and replace cabinet face assemblies 18, such that a user, such as an owner, contractor, or developer can easily switch modular door face assemblies 18, drawer face assemblies, and associated hardware, to rapidly change the entire look of the cabinetry system.

Modular cabinetry face assemblies 18, such as framed faces 18*a*,18*c* and full panel faces 18*b*,18*d* preferably comprise a wide variety of materials and finishes, such as to provide a spectrum of choice at various price points.

The choice of face assemblies 18 and associated cabinet carcasses 100 are typically grouped into different materials, finishes, and/or price points, such as but not limited to:

Laminates;

Paint grade wood with choice of paint finish;

Wood veneers in a flat front finish;

Wood veneers with framed door details;

Framed doors with a wood frame and inset panel (e.g. glass or other material);

Lacquer finishes, in either a flat front or framed door style, with either a high gloss or matte texture;

Metal finishes (brushed aluminum, stainless steel, copper);

Fully frameless glass doors in a variety of finishes and textures (e.g. clear, frosted, tinted or finished with a painted color on the back);

Plastic fronts, in a variety of custom colors or images with a flat front or with an embossed or vacuum shaped "3D" textured front;

Glass doors with an image screened or laminated between glass panels;

Solid doors with an image screened or laminated on the front;

Glass or solid doors screened or laminated with a custom image created and supplied by the user, developer, or owner; and/or Display screen doors, with a single or multiple panel area (e.g. television or computer monitor screens).

Color Selection and Matching. As the modular cabinet structures 12 comprise face assemblies 18 which are quickly removed and replaced, without the cost of replacement and of entire cabinet doors and drawers, the system inherently provides an opportunity to provide users USR with a greater variety of materials, finishes, and colors.

For example, in some preferred system embodiments 524, a user is not limited to a selection of colors from a palette of previously manufactured face assemblies 18. In contrast to conventional selection of available colors, such preferred system embodiments 524 provide color matching to any specified color, such as a selection of a PANTONE™ color, a selection of any CMYK or RGB standard color.

As well, such preferred system embodiments 524 may preferably provide color matching to an item selected by the user or designer, e.g. to match their appliances, their favorite fingernail polish, their car, their favorite flower, their dog or cat, or even their hair or eyes. For such items, a swatch, photograph or scan of a favorite object can provide one or more "unique" color choices, through which the user or designer can select the desired color or shade, i.e. the blonde streak in my hair.

Since modular face assemblies 18 are inherently separable from the structural frames 16 in the modular cabinet structures 12, a modular system 524 (FIG. 32) can be partially installed, whereby carcasses 100 and frames 16 may be installed independently of the delivery of a chosen set of face assemblies 18 and associated hardware, e.g. handles 68. In a construction project, therefore, the delivery of face assemblies 18 is not a critical item to the majority of work, such as the installation of base cabinets 100 and upper cabinets 100 in a kitchen installation KT, and the attachment of frame structures 16 to the caracasses 100.

Cabinet Carcasses. The modular cabinet system 12,524 is easily integrated with a wide variety of cabinet carcasses, i.e. boxes 100. In some system embodiments 524, all the cabinet carcasses 100 are constructed using the same materials, and associated attachment hardware (e.g. hinges, drawer glides), throughout one or more face assembly product levels 18. In some system embodiments 524, the door hinges 112 are Salice hinges, available through Arturo Salice S. p. A., Italy, such as distributed through Salice America Inc., of Charlotte, N.C. As well, in some system embodiments 524, the drawer glides and other interior accessories are sourced from Julius Blum GmbH, Austria, such as available through Blum, Inc., of Stanley, N.C.

In some system embodiments 524, the door hinges 112 are zero-clearance hinges 122, which allow modular cabinet doors 118 to be placed close together within a modular cabinet system 524, e.g. having a separation distance 352 (FIG. 23) of approximately 4 mm, whereby doors 118 do not contact other cabinetry, e.g. neighboring doors 118 or drawers 526, during opening or closing 521 (FIG. 32).

In some preferred system embodiments 524, the cabinet carcasses 100 are comprised of WOODSTALK™, available through Dow Chemical Company, of Midland, Mich. WOODSTALK™ is an environmentally friendly composite board which includes wheat straw fibers, and typically incorporates a layer of MDF (medium density fiberboard) on the exterior surfaces, which allows for a lamination of the finishing material.

In some embodiments of cabinet carcasses 100, such as comprised of WOODSTALK™, the carcasses 100 comprise a protective outer, i.e. laminate, layer, such as melamine, preferably having a color, which matches the structural door frames 16 and/or the face frames 18, such as a gray or pearlescent gray, to match a structural frame comprised of aluminum or aluminum alloy frame members 52,54.

In other preferred system embodiments 524, the cabinet carcasses 100 are comprised of water resistant acrylic sheet, such as a light diffusing acrylic sheet product that is completely water resistant and provides a slight degree of light allowance through the carcass 100.

Figure 23:
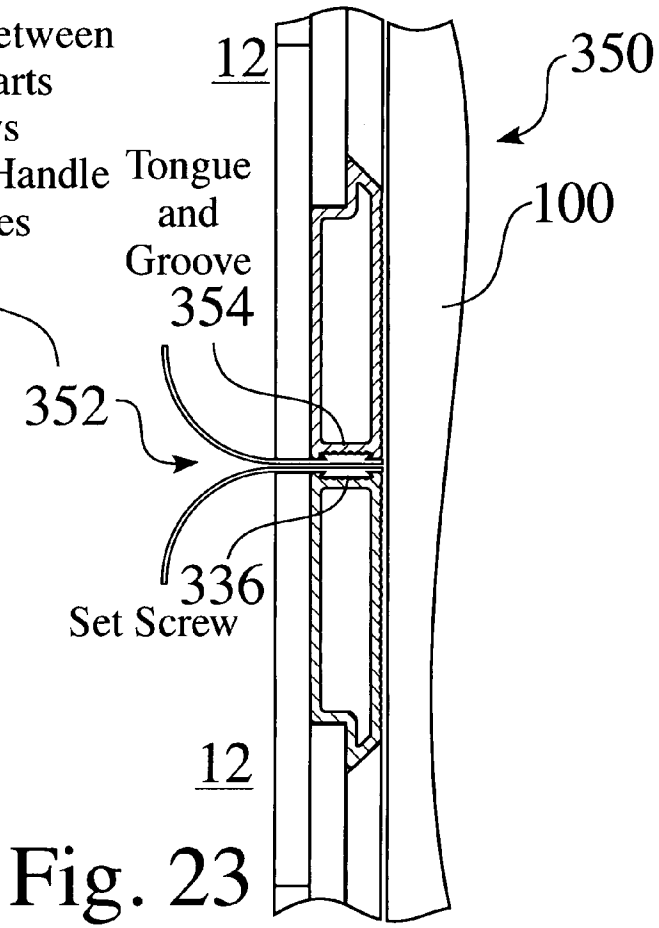
FIG. 23 is a top cutaway view of cabinet handles installed within cabinet frame extrusion channels.
Figure 22:
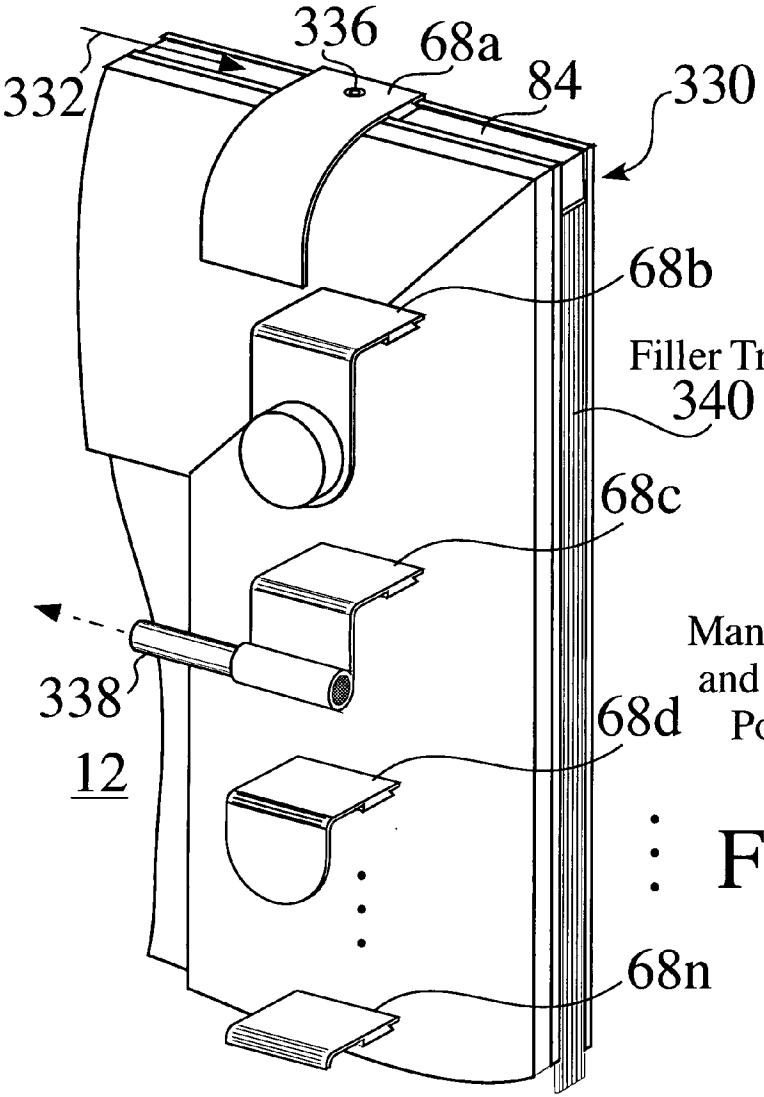
FIG. 22 shows door frame hardware options for a modular cabinet system.

Modular Cabinet Frame Hardware Options. FIG. 22 shows 330 door frame hardware options for a modular cabinet system 12. FIG. 23 is a top cutaway view 350 of cabinet handles 68 installed within cabinet frame extrusion channels 84, on opposing modular cabinet doors 12. As described above, some preferred embodiments of the modular cabinet structure 12 provide a channel 84 defined about the perimeter of the structural frame 16, such as an extruded groove or channels 84 (FIG. 5) within one or more frame members 52,54.

The recessed channel 84 allows handles 68 to be mounted at several locations around a cabinet structure 12, such as at any position on any four sides of the door frame 16.

As seen in FIG. 22, a large variety of handles and/or pulls 68*a*–68*n* are installable within the channel 84, and typically include a mechanical fastener 336, such as but not limited to a countersunk screw or setscrew 336. As seen in FIG. 22 installable hardware 68 may preferably comprise an integral rack handle 68*c*, such as including a rod or bar 338 which extends between two pulls 68*c*, such as to provide either an extended handle or a utility bar 338.

As further seen in FIG. 22, a perimeter channel 84 can accept a filler strip 340 such as to fill or highlight the channel 84 and provide a more consistent visual appearance along the outer edge 78*a* (FIG. 5) of the structural frame 16. In some system embodiments 12, filler trim 340 can be used around the entire door frame 16, such as for users who prefer traditional style handles which are drilled through the front of the face assembly 16, or in conjunction with channel-style handles 68, to fill in exposed areas of the channel 84 around the handles 68.

While the exemplary hardware 68,340 shown in FIGS. 22 and 23 comprises handles, pulls, racks, and trim, the edge channel 84 can alternately be used to retain system hardware, e.g. fillers and/or extensions 532. As well, the edge channel 84 can retain a wide variety of other objects, such as but not limited to appliances mounted to a frame structure 16 on the lower edge of a cabinet door 12. For example, an electronic appliance, such as a clock, personal digital assistant (PDA), flat panel television screen, digital recipe keeper, or baby monitor may readily be mounted to the channel 84, either as a dedicated appliance specifically adapted to be mounted to the channel 84, or connectable through an intermediate bracket 68.

Figure 24:
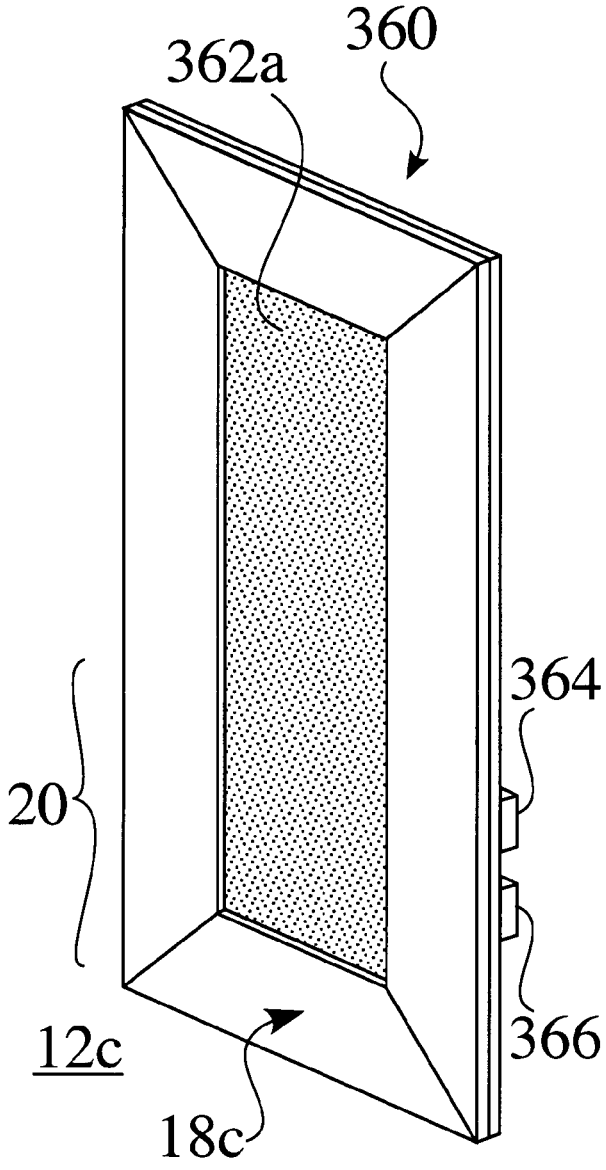
FIG. 24 is a perspective view of a framed display panel modular cabinet assembly.
Figure 25:
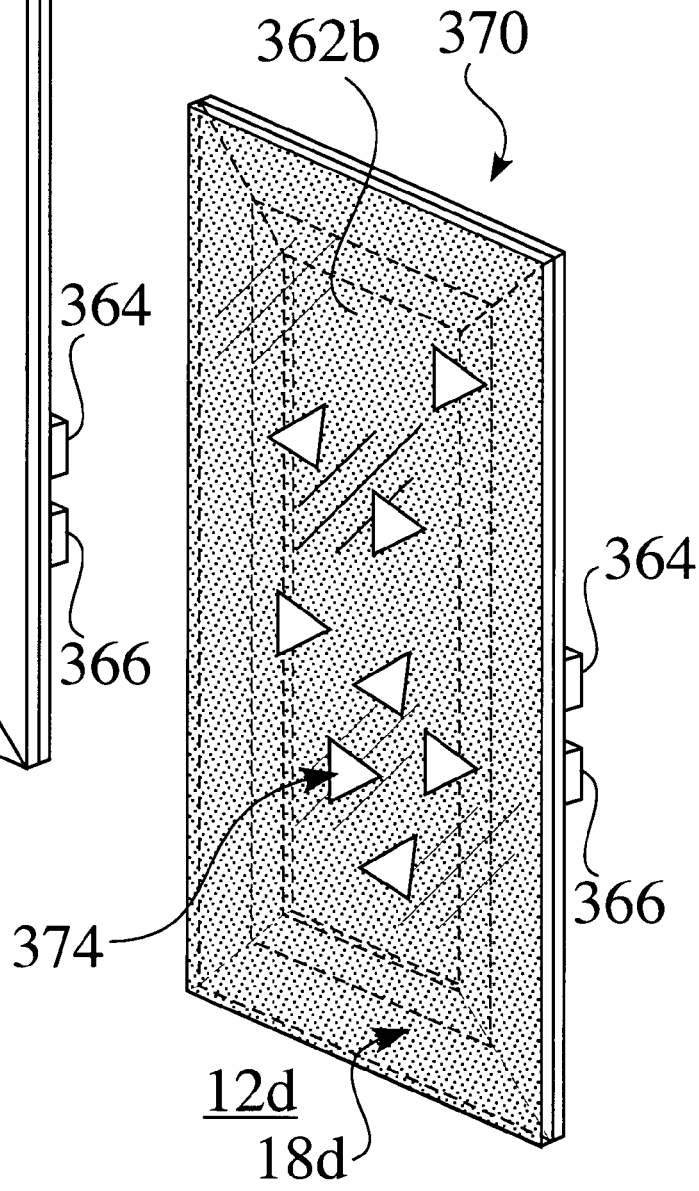
FIG. 25 is a perspective view of a full display panel modular cabinet assembly.

Cabinet Display Panels. FIG. 24 is a perspective view 360 of a framed display panel cabinet 12*c*, such as compatible with frame style cabinet structures 12*a*. FIG. 25 is a perspective view 370 of a full display panel modular cabinet assembly 12*d*, such as compatible with the full panel cabinet structures 12*b*.

The modular cabinet structure 12, system 524, and process 300 inherently allow a user to readily install, remove, and replace face assemblies 18. In addition to basic renovation of cabinets, the structure 12 also inherently provides the ability to integrate alternate structures into the same structural frames 16. Therefore, in some preferred system embodiments 12, one or more panels 18 can be replaced with enhanced face assemblies 18*c*,18*d*, to provide display panels 362*a*,362*b*, such as to be integrated into a computer system, a television display, and/or a dedicated display screen 362*a*,362*b*.

For example, as seen in FIG. 24, while the outer frame 18 may be chosen to match other cabinet doors and drawers 12 within a kitchen KT, one or more panels 12*a* may be replaced with framed display panels 12*c* having a similar outer frame 20, such as to provide an integrated television screen or computer monitor 362*a*,362*b*, without taking up valuable counter space or wall space.

Display panel assemblies 12*c*,12*d* can be readily integrated within a modular cabinet system kitchen 524, either during the initial construction, or as a modular upgrade, which can match the fit and finish of the surrounding cabinets.

The display panel assemblies 12*c*,12*d* typically comprise an interface 364, e.g. wired or wireless, for receiving signals, and preferably comprise other componentry 366, such as for signal processing, power, and/or integrated speakers.

In some embodiments of the display panel assemblies 12*c*,12*d*, one or more panels 12*c*,12*d* receive images via a on-line "wired" transmission, which changes the appearance of the front 18, without the need to even change the face assembly 18.

As well, a plurality of display panels 12*c*,12*d* may preferably be coordinated to show a large image spread over several panels 12*c*,12*d* in a section, or single panels 12*c*,12*d* can be used to display individual images 374. In some display panel embodiments 12*c*,12*d*, a user may choose from a library of available images, such as stored personal images, e.g. family photos, or, externally stored images, such as available either by an ongoing subscription or on a one-off basis. F or example, through a n external web site 620,630 (FIG. 38), a user, i.e. client can review images 374 available, and order changes directly on-line, without any need to visit a local showroom. As well, some display embodiments allow a user USR to download images from the web from a variety of sources, or scan their own images (artwork, photographs) and have them transmitted to the panels 12*c*,12*d* in their kitchen KT.

Filler Hardware. There are typically two types of fillers used in typical kitchen installations. Straight fillers are commonly used between the end of a cabinet and an adjacent wall, and are usually referred to as base fillers, wall fillers, and/or tall fillers. Corner fillers are commonly used between cabinets for corner applications. Conventional fillers typically comprise a backing material which is covered by the same finish as the installed door fronts.

Figure 26:
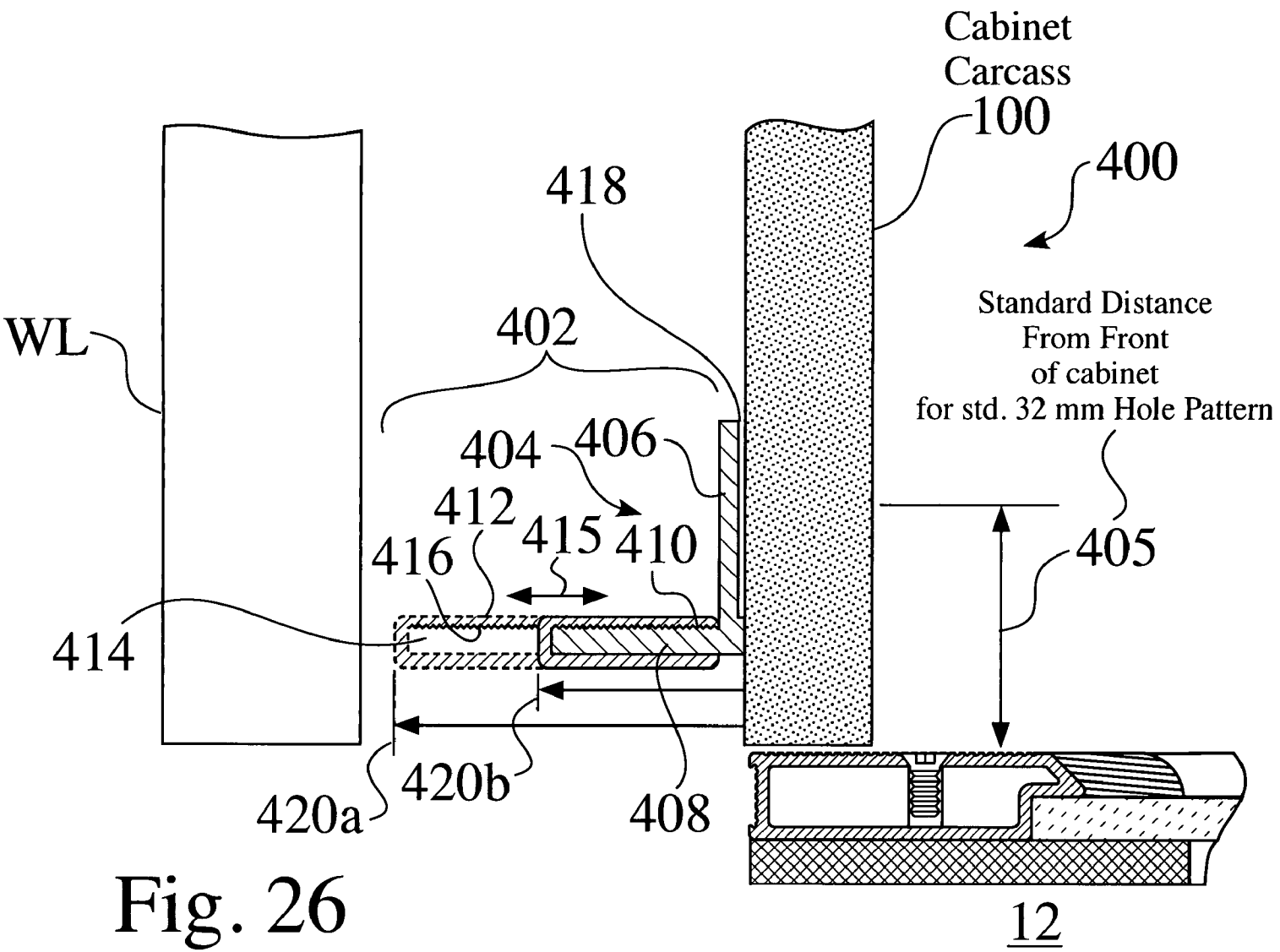
FIG. 26 is a top cutaway view of an adjustable trim piece for a cabinet system.
Figure 27:
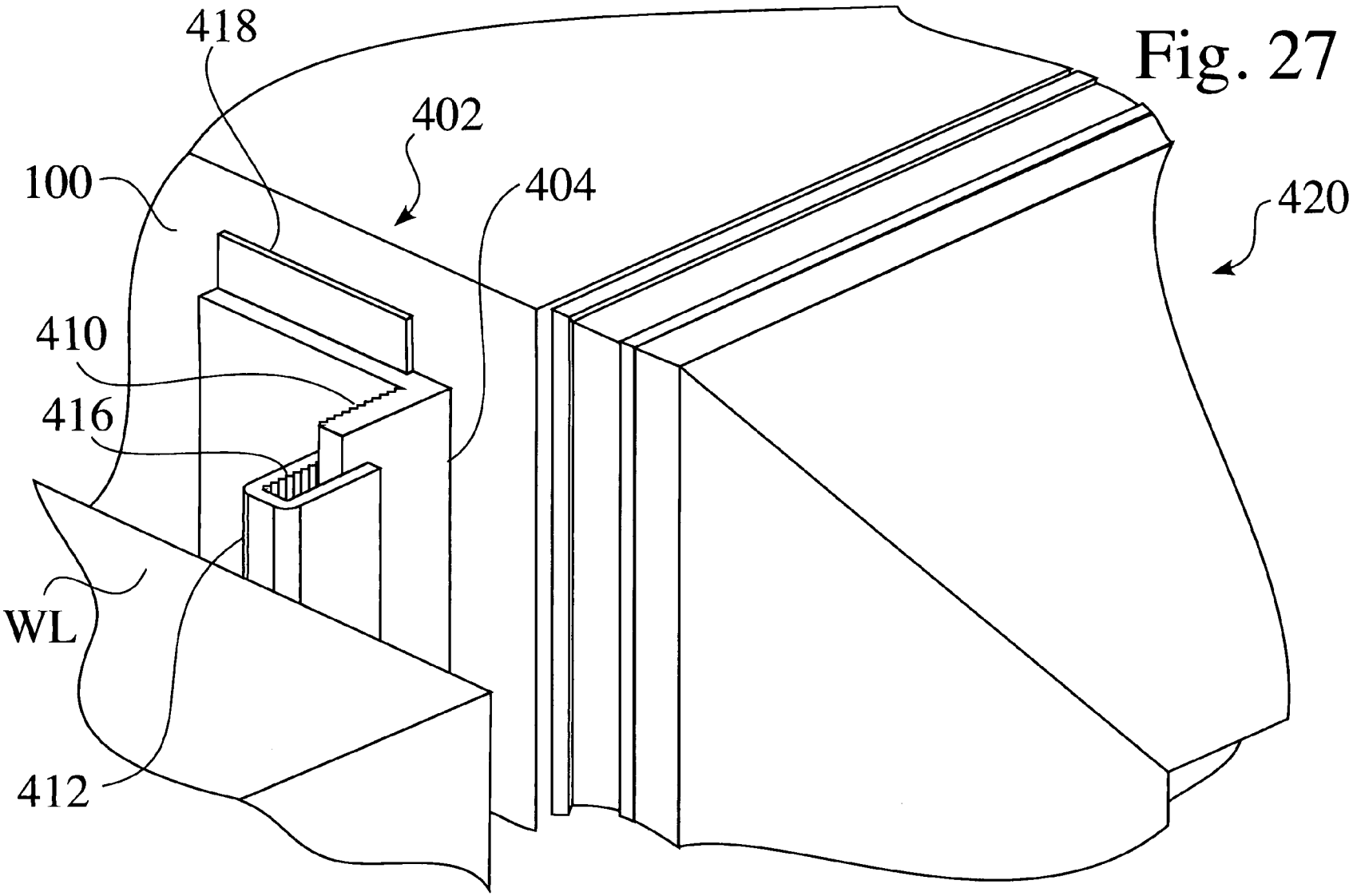
FIG. 27 is a perspective view of an installed adjustable trim piece for a cabinet system.

Adjustable Trim for Cabinet Systems. FIG. 26 is a top cutaway view 400 of an adjustable trim assembly 402 for a cabinet system. FIG. 27 is a perspective view 420 of an installed adjustable trim assembly 402 for a cabinet system.

The adjustable trim assembly 402 typically comprises a base extrusion 404 and a trim extrusion 412, which are movably adjustable 415 with respect to each other, such as between a first fully extended position 420*a* and a second fully closed position 420*b*. In one embodiment 402, the assembly adjusts from a length of 19 mm (¾") 420*b* to 28 millimeters (1⅛") 420*a*while another embodiment 402 adjusts from 32 mm (1¼") 420*b* to 54 mm (2⅛") 420*a*. As there is seldom a gap 403 wider than 2" between a cabinet 100 and an adjacent wall WL, the described embodiments of the adjustable trim assembly 402 provide an adjustable fill solution for most installations.

In the exemplary trim embodiment 402 shown in FIG. 26 and FIG. 27, the base extrusion 404 comprises a mounting surface 406, and a filler surface 408, which extends from the mounting surface. The mounting surface 406 is mountable to an external surface, e.g. a cabinet carcass 100 or a wall WL, such as by double stick tape 418. The filler surface includes means for movable engagement 410 in relation to the trim extrusion 412.

The exemplary trim extrusion 412 shown in FIG. 26 and FIG. 27 comprises a defined mating region 414, which preferably includes means for respective engagement with the filler surface of the base extrusion 404.

The adjustable trim assembly 402 is readily used in place of standard "straight" fillers, and is expandable to accommodate a wide variety of dimensions. The adjustable trim assembly 402 may preferably be finished in the same material as the chosen toe kick 502 (FIG. 30), rather than the front face 18 of the cabinet doors 12, to provide a neutral finishing element, and creating a visual frame around the edge of an end cabinet 100.

The adjustable trim assembly 402 can be placed at a variety of depths on the cabinet side. For example, some users may prefer the filler trim 402 to be in alignment with the front of the cabinet door, while other users may prefer the filler trim 402 to be set back to the same depth as the toe kick (or "plinth"), to create a more subtle shadow line.

Figure 30:
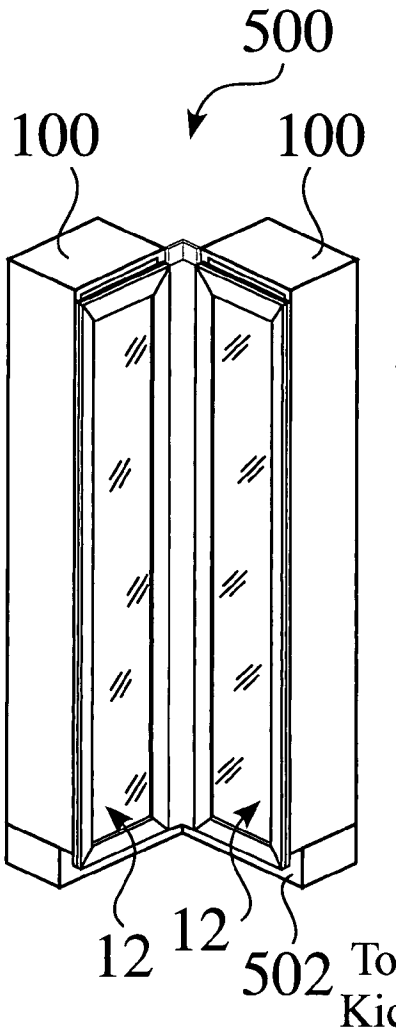
FIG. 30 is a perspective view of a fixed void corner filler, as it relates to two adjacent cabinets.

Rather than screwing the filler 402 to the inside of the adjacent cabinet 100, the trim pieces are preferably mounted on the side of the cabinet 100, using industrial strength double stick 418, which eliminates the need for additional drilling through the interior side panel of the adjacent cabinet carcass 100. In addition, the user or owner can readily select the placement of the trim 402, such as forward, flush with the front face of the cabinet carcass 100, or recessed, in alignment with the toekick 502 (FIG. 30).

Corner Filler Hardware. Most production line cabinets require the use of "fillers" to accommodate the various and unique sizes of existing residential kitchens. These fillers complete the space between the end of a cabinetry run (at base, wall or tall cabinet sides) and a wall, or in a corner situation. Such fillers are usually cut on site to the exact size required, and are made of the same material as the front face of the cabinet doors. Fillers are usually installed by drilling through the side of the adjacent cabinet carcass, and once installed are difficult to replace.

The modular cabinet system 524 provides a variety of enhanced corner filler elements and associated trim for different applications, which are readily integrated with modular cabinet structures 12, and can be further enhanced, such as with trim 572 and cladding 516, to create a cohesive design. The improved filler hardware is simple to install in an initial system configuration, and is easily changeable at such time a user decides to upgrade or update the system appearance, such as with new front cabinet face assemblies 18. Unlike straight fillers for the end of a cabinet run, e.g. 402 (FIG. 26), corner fillers are preferably finished in the same material as the adjacent cabinet doors, e.g. 12, as corner fillers preferably appear to be part of the neighboring cabinetry.

Figure 28:
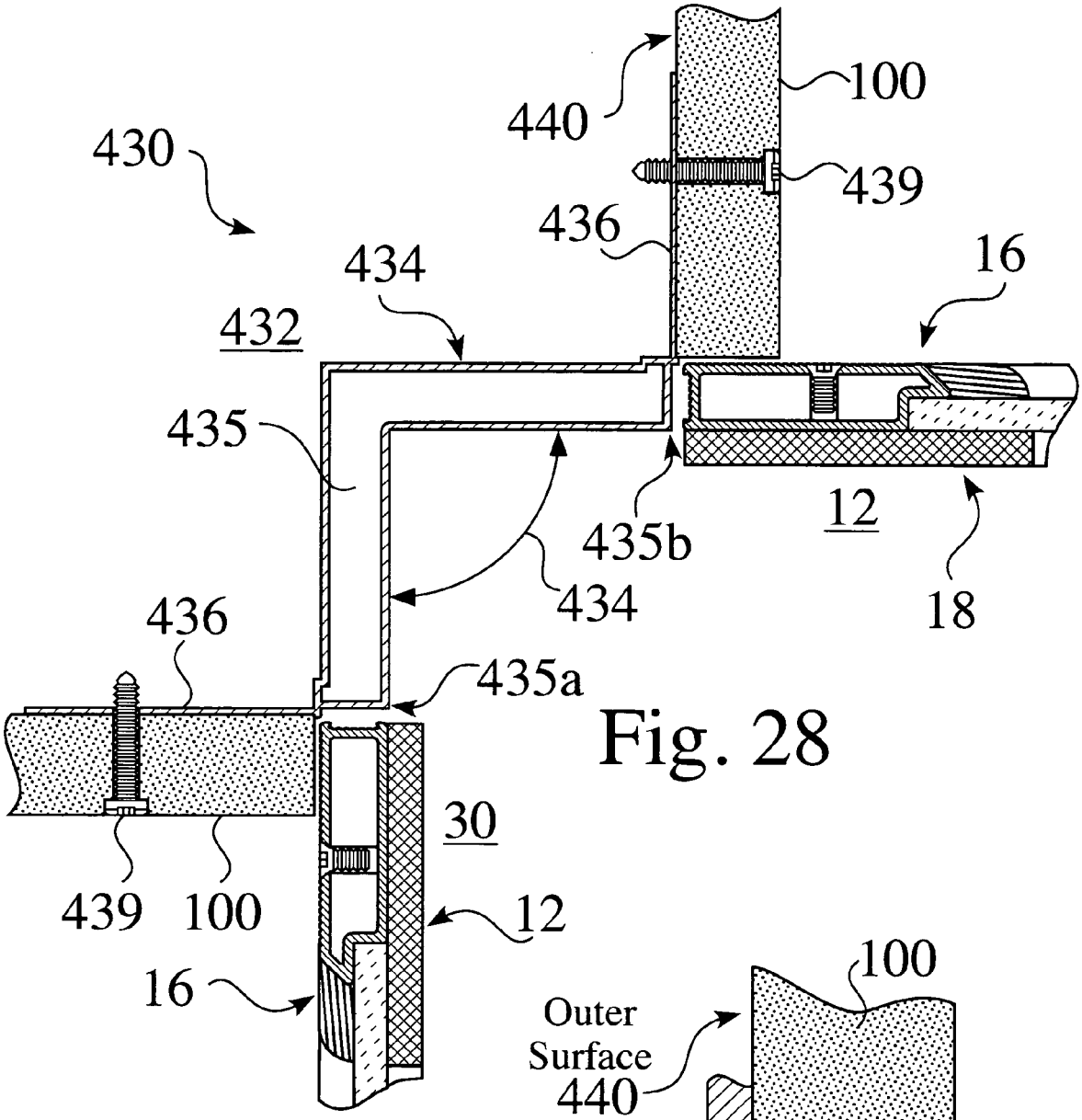
FIG. 28 is a top cutaway view of a corner filler extrusion installed between two adjacent cabinets in a "void corner" application.
Figure 29:
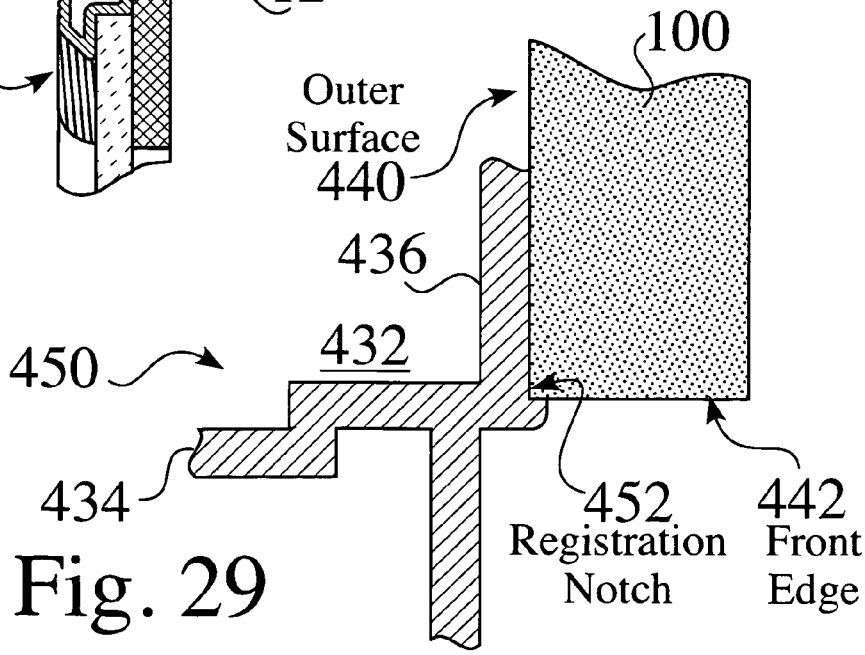
FIG. 29 is a detailed partial cross sectional view of a corner filler extrusion.
Figure 31:
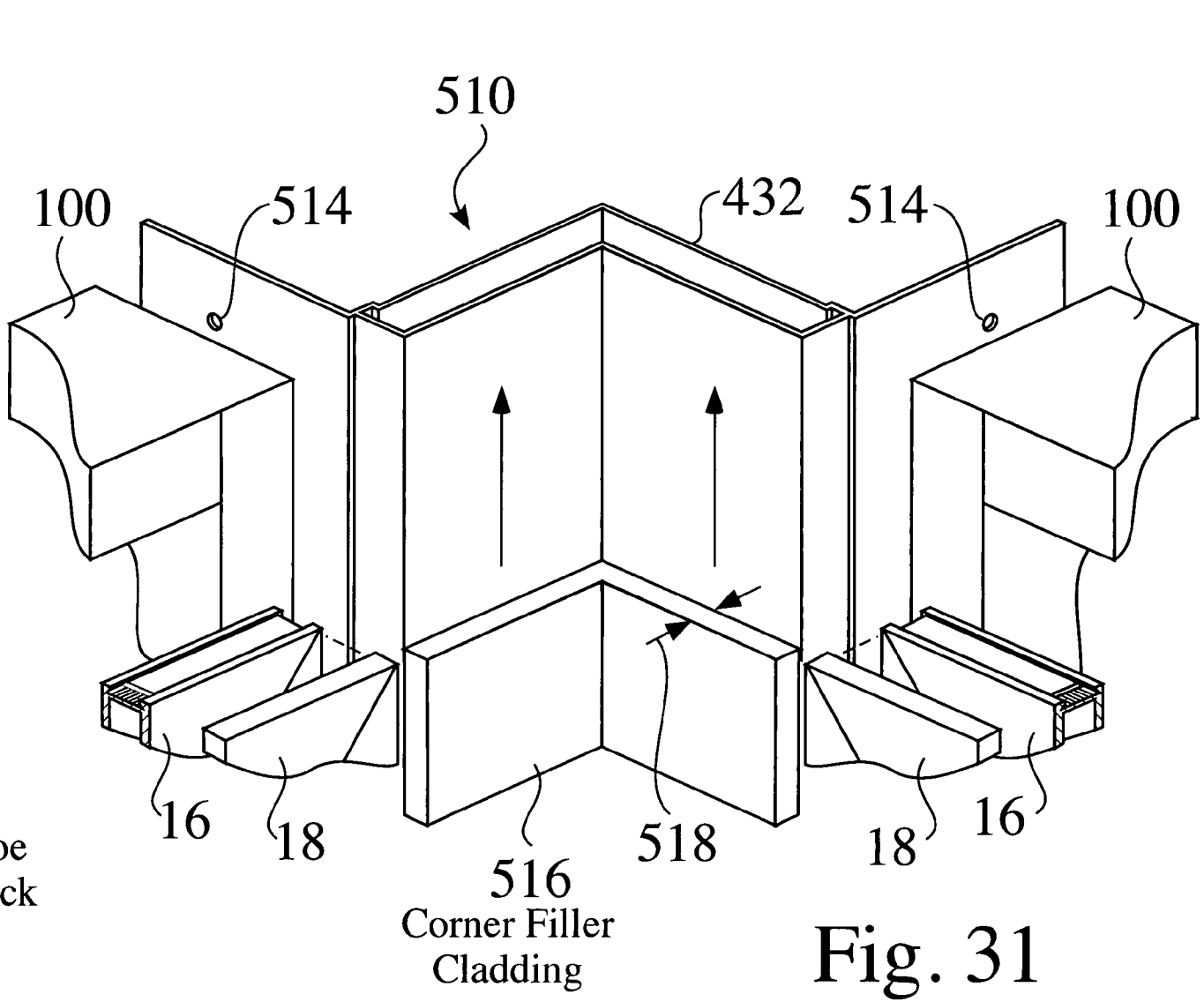
FIG. 31 is an exploded cutaway view of a corner filler, as it relates to two adjacent cabinets.

FIG. 28 is a top cutaway view 430 of a corner filler extrusion 432 installed between two adjacent cabinets 100 in a "void corner" application. FIG. 29 is a detailed partial cross sectional view 450 of a corner filler extrusion 432 fitted to a cabinet carcass 100. FIG. 30 is a perspective view 500 of a fixed void corner filler 432, as it relates to two adjacent cabinets 100. FIG. 31 is an exploded cutaway view 510 of a corner filler 432, positioned between two adjacent cabinets 100. A corner filler 432 fills the gap between two adjacent cabinets, such as for base cabinets, tall cabinets, or for wall cabinets.

The corner filler 432 is preferably comprised of an extruded metal, e.g. aluminum or aluminum alloy, and typically comprises a hollow region 435 defined therethrough. While the exemplary corner filler 432 shown in FIG. 28 is adapted for a 90 degree corner 434, between extrusion sections 435*a*,435*b*, other corner fillers 432 may preferably be adapted for other corners, such as for a 135 degree corner 434.

The corner filler 432 also comprises backing extrusion features 436, preferably comprising a registration landing or notch 452, as seen in FIG. 29, whereby the corner filler 432 may easily and accurately be located and aligned to the outer surface 440 and to the front edge 442 of the adjacent cabinets 100 before assembly.

The corner filler 432 is readily attached to the cabinet carcasses 100, such as by fasteners 439, which in one embodiment comprise recessed Torx™ Pan Head self-tapping sheetmetal screws, such as available through McMaster-Carr, Inc., of Atlanta, Ga.

The corner filler 432 may preferably comprise predrilled holes 514 (FIG. 31), such as corresponding to a standard hole pattern 405 (FIG. 26), typically 32 mm, that is already drilled inside the cabinets 100. By using the existing hole pattern 405, the corner filler 432 can be easily removed if and when a user decides to upgrade the modular front panels 18. Alternately, the holes 514 may be drilled in place, before installing the fasters 439.

As seen in FIG. 31, the corner filler 432 is typically covered by a corner filler cladding 516, whereby the visible front edges of the corner filler 432 are preferably clad 516 with the same material as the selected front face 18 of the modular cabinetry 12. The corner filler cladding 516 preferably has the same thickness 518 as the adjoining front faces 18 of the modular cabinets.

Figure 34:
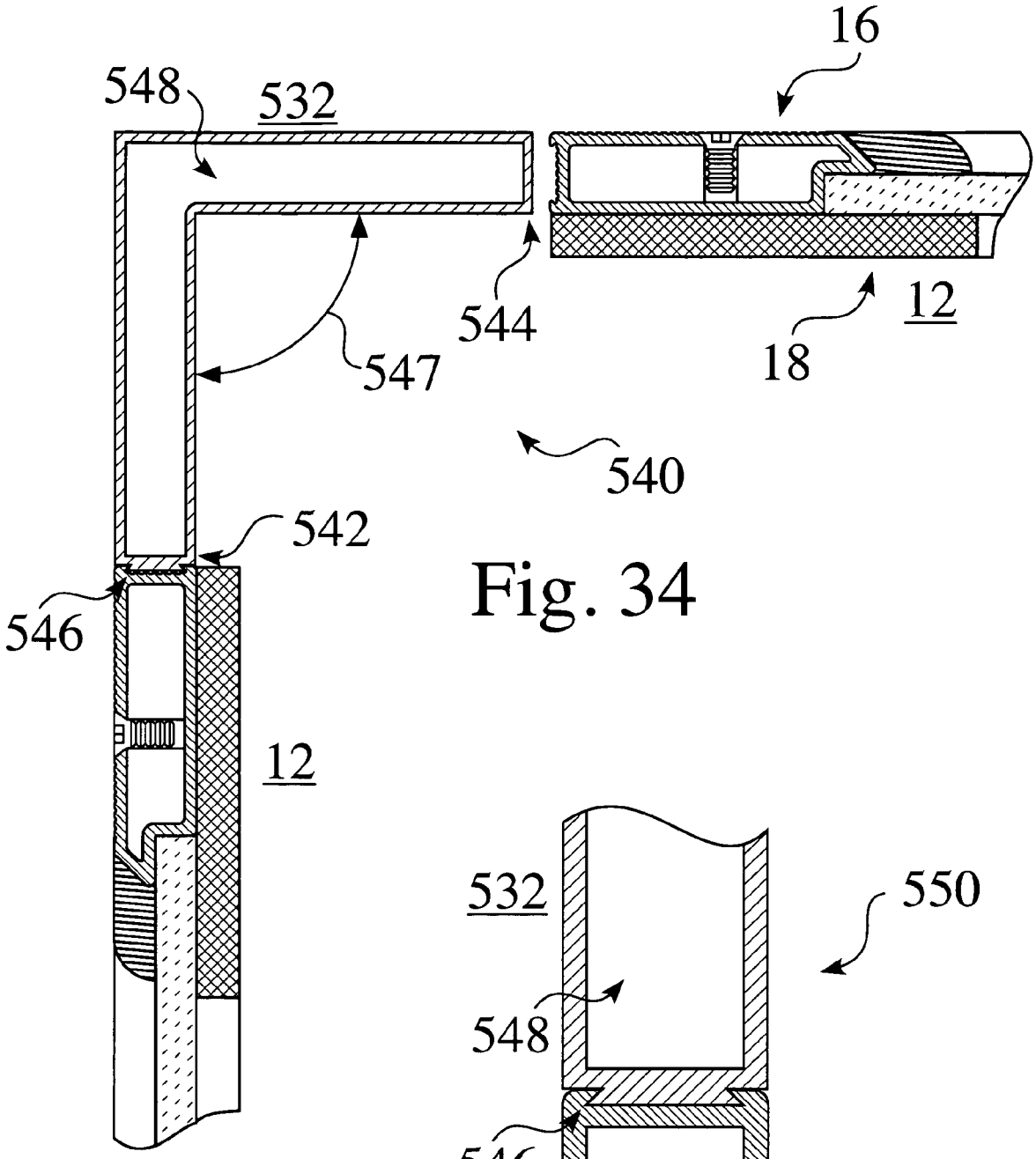
FIG. 34 is a top cutaway view of a of an installed corner door extension attached to one of the hinged doors on the cabinet.
Figure 35:
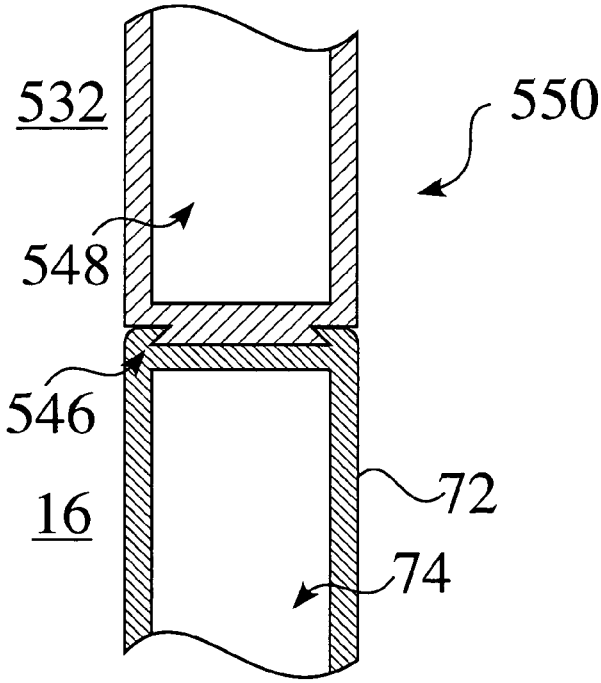
FIG. 35 is a detailed partial cross sectional view of an installed corner door extension.

Corner Door Extension Hardware. FIG. 32 is a plan view 520 of a corner cabinet 522 with a corner door extension 532 in place, attached to a left hand side door 12 within a kitchen environment KT. FIG. 33 is a detailed top cutaway view 530 of a corner door extension 532 attached to a left hand side modular door 12. FIG. 34 is a top cutaway view 540 of an installed corner door extension 532 attached to one of the hinged modular cabinet doors 12 on the corner cabinet 522. FIG. 35 is a detailed partial cross sectional view 550 of an installed corner door extension 532. The corner door extension 532 preferably provides a visual connection between neighboring doors 12 in a corner cabinet 522.

The corner door extension 532 comprises a filler for corner cabinets 522, where the filler is attached to one of the hinged doors 12 for the corner cabinet 522. The corner filler 532 is affixed to the one door 12, by utilizing the channel 84 running along the perimeter of the structural frame 16. The connecting edge 542 (FIG. 34) of the filler comprises a mating region 546 which is slidably positionable and affixable to the channel 84, to connect the filler 532 to the structural frame 16. The slidable installation of corner door extensions 532 within the channel 84 rimming the perimeter of the modular cabinet structural frame provides accurate alignment between adjacent modular doors 12. As well, the corner fillers 532 are easily removable from the cabinet door frame 16, such as for replacement if a user chooses to upgrade the front panels 18.

Figure 36:
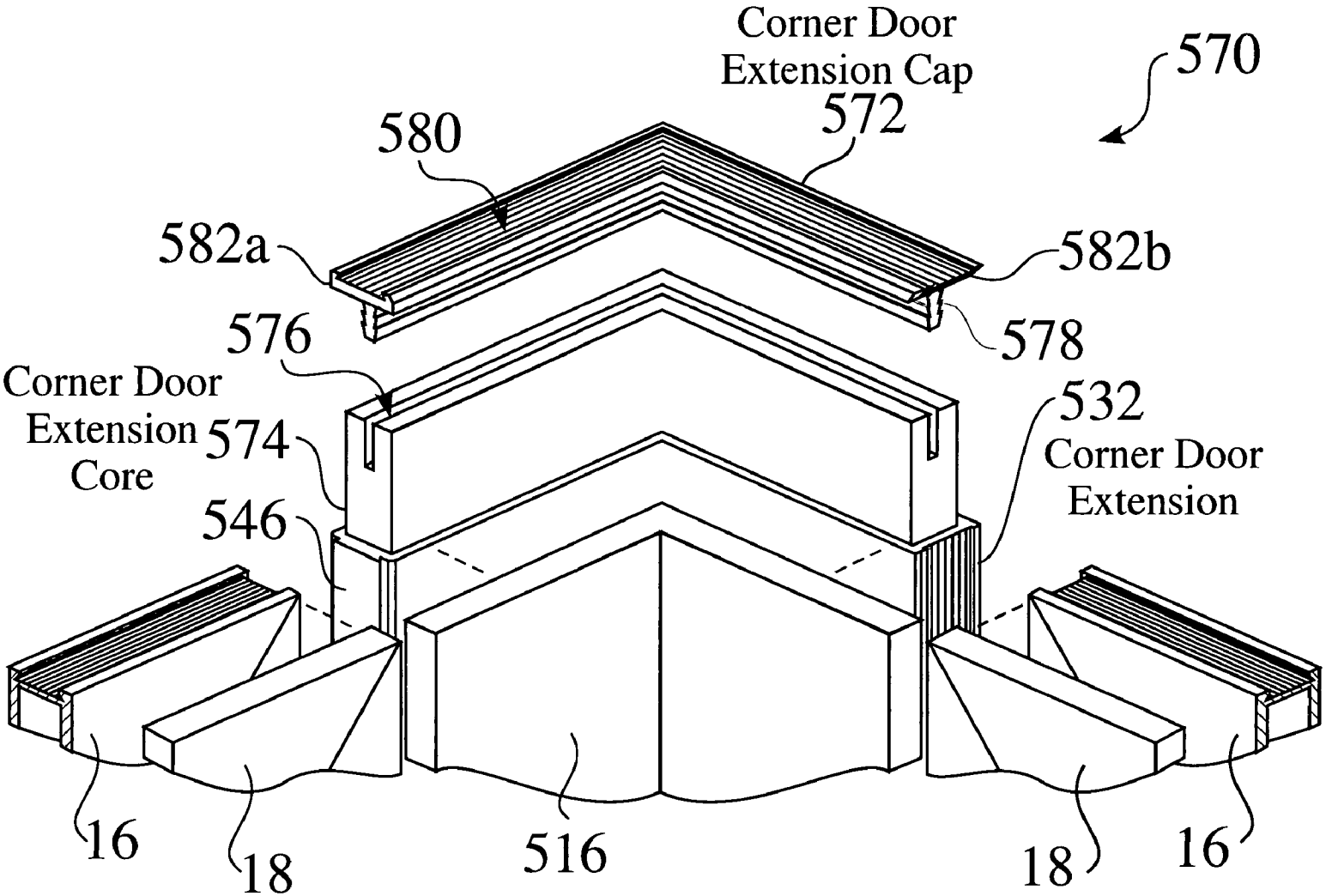
FIG. 36 is an exploded assembly view of a corner filler for corner cabinets.

Corner Door Extension Trim. FIG. 36 is an expanded detailed assembly view 570 of a corner door extension cap 572 and an associated corner door extension core 574 for a corner extension filler 532.

As seen in FIG. 34 and FIG. 36, a connection feature 546 of the filler 532 dovetails into the adjacent door frame 16. A capping piece 572 located at the top of the corner filler 532, such as through an intermediate extension core 574, preferably provides visual continuity to the modular cabinets, typically by using the same edge detail 580 as edge detail 86 (FIG. 5) of the structural door frame 16.

Figure 37:
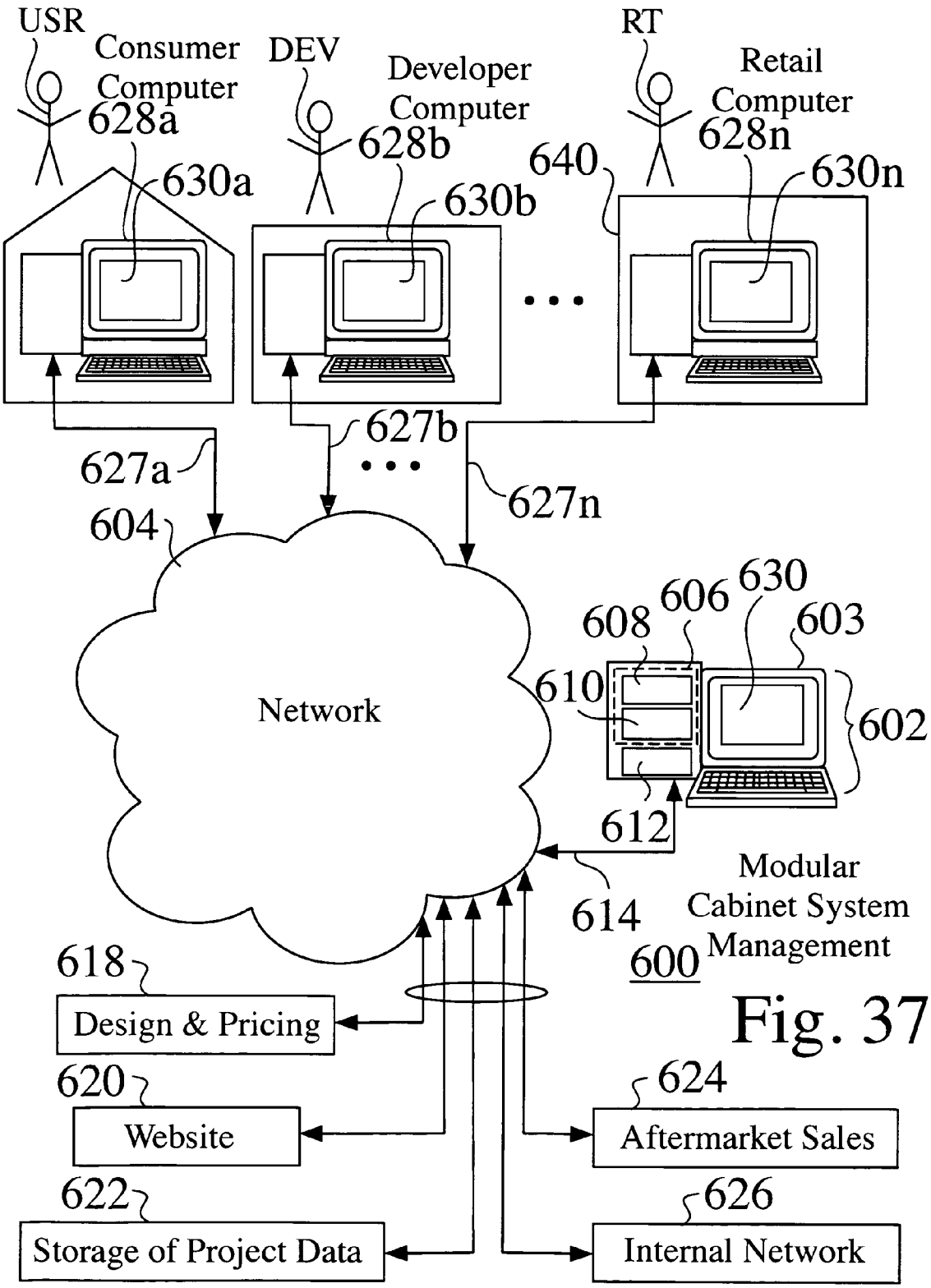
FIG. 37 is a schematic view of a modular cabinet management system implemented across a network.

Cabinet Management Network System. FIG. 37 is a schematic view of a modular cabinet management system 600 implemented across a network 604. The exemplary modular cabinet management system 600 shown in FIG. 37 provides several functions and services, such as design and service 618, a comprehensive web site 620, input and ongoing storage 622 of project data, e.g. CAD drawings and parts list for a new or existing kitchen, aftermarket sales and service 624, and an internal network 626.

The exemplary modular cabinet management system 600 shown in FIG. 37 includes one or more management terminals 602, such as comprising processing and storage 612 and display 603. Information 606 specific to system management 600 typically comprises software 608, system and client information 610, and a comprehensive web site interface 630 which provides access and management to any or all components of the web site architecture 620. A large variety and number of users USR preferably a have access to appropriate portions of the modular cabinet management system 600 across the network 604, e.g. the Internet. For example, a residential or consumer user USR can access the system 600 through a consumer portion, i.e. consumer web pages 630*a*, while a developer user DEV can access the system 600 through a developer portion, i.e. developer web pages 630*b*. Similarly, retail and design center users RU can access the system 600 at a retail/showroom terminal 628, through retail/showroom web pages 630*n*.

Web Site Functionality. For prospective new clients, the web site 620,630 provides an introduction to the products, technology and services, and allows them to interactively "play" with the possibilities, and to view the range of cabinets, hardware, and/or materials. Should a prospective client show interest, the web site 620,630 preferably guides them to receive a preliminary cost estimate, and directs them to their local showroom SR.

The web site 620 also provides ongoing information and service to clients in the process of ordering a modular cabinet and/or kitchen system 524. Clients can track their own projects, from manufacture through delivery, and receive the current status of the location of their cabinetry furniture, as well as their scheduled delivery and installation.

The web site 620,630 preferably comprises a design and order processing system 618, which maintains all client and project information 622 on a comprehensive database. Designers and support personnel have access to internal project data, such as costs and client contact history, while relevant project information is available to clients on-line, which greatly reduces the number of telephone calls required to "check on the status" of their order. All information regarding individual parts orders is also preferably accessible through the web site 620,630, which assures clients that their order has been processed, and provides them with detailed delivery information.

Because of the ability to upgrade the appearance of the kitchen without substantial cost or trouble, rather than by completely remodeling, clients will likely purchase new front panels 18 for their cabinetry system 524 at least once, and potentially several times during the life of the kitchen KT. Original purchasers may choose to upgrade to better quality materials, or to change the appearance of the kitchen, while new purchasers of a home with a modular cabinet system 524 may desire to customize their new homes with new panels 18, to reflect their own taste and personality.

For existing owners of a modular cabinet system 30, the web site 620,630 provides a simple, cost effective sales tool for after market sales. By logging on to the web site 620,630 and inputting a unique project identification number into the "existing clients" section of the site 620, a client is able to pull up their actual kitchen design. Original drawings, e.g. CAD, from the initial kitchen installation are preferably stored in the central database 622, and each cabinet front 18 is identified within the design. The existing owner or new home purchaser is able to see how new fronts would look in their own kitchen, and, since all technical data is available, they are able to purchase new fronts 18 on-line, have them delivered directly to their home, and, if desired, installed by a professional installation team associated with the network system 600.

The web site 620,630 preferably provides the complete selection of front finishes available for preview on-line. In addition, a periodic, e.g. quarterly, magazine, is preferably available, in print and/or on-line, which highlights new finishes in general and "limited edition" artwork that can be licensed for higher-end kitchen cabinets 30. The periodic magazine typically includes any new elements that are available for the system, such as but not limited to utility channels, backsplash accessories, upgraded display panels, e.g. television or computer displays or monitors, lighting, appliance garages, and/or built-in appliances.

Services. In addition to the standard services currently provided to cabinet purchasers (design and layout, ordering and delivery), the cabinet management system 600 preferably provides a comprehensive array of services which assist the client in the process of choosing, ordering and installing an modular cabinet system 524. These services will include the following:

One-stop shopping. In addition to offering modular cabinet systems 524, preferred embodiments of the cabinet management system 600 offer a wide selection of related products and services, such as but not limited to appliances, countertops and backsplashes, as well as integrated cabinetry lighting, e.g. everything between the floor and ceiling. By preferably editing the choices for the clients, the work of the designer is streamlined, by offering appliances that are limited to makes and models that work well with the cabinetry system 524.

As well, the fabrication and delivery of countertops and splashes is preferably coordinated with the delivery of the cabinetry 524, which greatly reduces the installation time, and provides a user USR or developer DEV with a functioning kitchen much more quickly than currently possible.

Start to finish coordination. With the exception of the general contracting work required for new construction or remodeling of existing kitchens, the cabinet management system 600 assists users from the initial design and layout of the cabinetry, through the ordering, delivery and installation of the furniture and countertops. Any and all of these phases of the project can be coordinated through the cabinet management system 600, which eliminates the need for the client, developer or contractor to coordinate with shipping agents, independent installers, appliance retailers and countertop fabricators.

Access to project status on the Web. Each project is assigned a unique project number, i.e. identifier, such that the status of the project during all phases is accessible by the client/developer/contractor by logging on to the web site 620,630, and inputting the project code. This service allows the client to see updates to the project status such as estimated completion date of fabrication, status of shipping and delivery date, and/or installation team assigned to the project. This service preferably remains in place throughout the completion of the project, and allows the client to track the status and estimated delivery of any replacement parts necessary to complete the project, such as though Federal Express or UPS tracking numbers.

Replacement Parts Priority Team. Any parts required after the delivery of the initial kitchen order will be assigned to a specific, dedicated Replacement Parts Priority Team, separate from the initial design and ordering team. Necessary parts are preferably shipped within 24 to 48 hours from receipt of the order, and whenever possible shipped via overnight services. Orders can be placed in the field by the installation team, rather than the team leader having to report back to the initial designer to place the necessary order.

System Advantages in the Consumer Market. The modular cabinet system 12,524 and associated process 300 allows the user, such as a consumer or developer, to play an active role in expressing their taste and personality in kitchen cabinetry. By offering users with the ability to easily and affordably update their kitchens' appearance, the modular cabinet system 30 eliminates the purchaser's concern about being "stuck with" their initial choice of finish and design style. A homeowner can completely change the look of their modular kitchen system 524, simply by replacing the front panels 18, which allows owners to upgrade their existing kitchen KT, as their tastes change and their economic status improves. These changes can be accomplished without the need for completely demolishing the existing kitchen KT, and the consumer experiences virtually no "down-time," as the replacement fronts 18 can be installed in less than one day.

The ability to easily change the appearance will be equally important when a new owner purchases a home with an existing kitchen having modular kitchen cabinets 30. New owners often desire to renovation a kitchen KT, which is a significant undertaking, requiring substantial sums of money (the average kitchen remodel is over $50,000) and resulting in the loss of a functioning kitchen for a period of typically two to three months or more.

An existing modular kitchen 524 may therefore be a key selling point in existing home sales. The system 524 inherently allows a new purchaser to renovate panels 18, such as to reflect their own taste and style, without sacrificing a functioning kitchen for an extended period of time.

System Advantages in the Developer Market. Developers DEV of high-rise projects or multi-family housing developments are concerned with two issues: cost and completion. Their choice of cabinets has less to do with aesthetics and style and more to do with selecting a supplier who can deliver accurately and on-time, allowing them to complete units and receive the corresponding Certificate of Occupancy, triggering the release of construction funds and allowing the developer to sell the unit.

The modular cabinet system 12 provides developers DEV of multi-unit projects with a solution which provides purchasers an individual choice in their units, without the logistical problems currently associated with "upgrades." The developer DEV can still contract with only one cabinetry supplier, and the floor plans can still be identical, but the individual purchasers have the luxury of choosing their own unique cabinet fronts 18, creating a modular kitchen 524 that does not look like the other owners' units on their floor or in the complex.

The developer DEV can therefore complete each unit with cabinet carcasses 100, drawer boxes 527, and temporary "loaner" fronts 18, which allows the developer DEV to install countertops, sinks, appliances, etc., obtain the important Certificate of Occupancy, sell the unit, and release the corresponding construction funds.

In some cabinet management system embodiments 600, as soon as a unit is sold, the developer DEV refers the purchaser to the cabinet management system 600, to select their standard or custom fronts 18 and any other finishing hardware, e.g. handles 68. For large developments, a representative of the cabinet management system 600 is preferably located in the developer's sales office or model unit. For smaller developments, the clients are preferably referred to a showroom associated with the cabinet management system 600, assisting purchasers with their selections of cabinet fronts. The purchaser can preferably select from a wide variety of finishes, with a standard allowance for fronts included in the purchase price. For an additional cost, the purchaser can preferably choose to order a higher priced, higher quality front assemblies 18. The entire selection, delivery and installation process is handled through the cabinet management system 600, which drastically reduces and often eliminates related administrative work from the developer DEV.

The modular cabinet system 524 and associated structures, e.g. 12, 68, 432, are particularly suited to high-end loft developments, where builders typically install minimal kitchens and closets, and no wall storage units, such as for bookcases, entertainment centers, and/or wardrobes. Therefore, some cabinet management system embodiments 600 preferably provide modular cabinet systems 524 and associated structures, e.g. 12, 68, 432 for these applications. Similarly, the purchaser user USR is supplied with a variety face assemblies 12, and associated hardware and trim, e.g. 68,432.

Preferred embodiments of cabinet management system 600 manage the ordering, tracking and delivery of new as well as replacement parts for one or more modular cabinet systems 524. Missing or damaged parts are automatically tracked to the original order, and replacement parts are preferably supplied within a 24 to 48-hour period, which substantially cuts down on costly delays, such as currently experienced during and after the installation phase of conventional cabinetry.

Ecological Factors Associated with Modular Cabinet System Structures and Processes. Eco-awareness and "green" marketing is a growing trend in the furniture industry today. Consumers are becoming more aware of the impact their choices and purchases make on the environment, and many are considering environmental issues when making their choices and purchases, even when there is a premium associated with the cost.

Unfortunately, waste is common in the kitchen cabinetry industry. During the manufacturing process, new technology and equipment has provided more efficient use of materials, but the amount of waste generated by the packaging alone is often close to equal the volume of furniture being installed in a new kitchen.

Some preferred embodiments of the cabinet management system 600 comprise "mobile packaging", which comprises containers and delivery truck interiors adapted to protect the individual cabinetry components, e.g. 12, 18, without the need to individually wrap each piece in cardboard or plastic. The installation team associated with the cabinet management system 600 removes the cabinetry and finishing elements from the truck interiors during the installation, which significantly reduces or preferably eliminates the vast amounts of packaging materials that usually end up in the construction site dumpster.

More important, however, is the long-term benefit of installing a modular cabinet system 524, e.g. a modular kitchen 524, in a new or remodeled single-family home or condominium unit. Because of the ability to change the appearance of the modular kitchen 524 by installing new fronts 18, homeowners can "remodel" without actually remodeling. Old cabinets don't need to be ripped out and discarded, existing countertops and appliances can remain in place, and new fronts can be delivered in the same reusable packaging described above, which are preferably taken away by the installers at the time of installation.

The ability to change the appearance without the need of a full remodel is equally important to the new owner of an existing home with a modular cabinet system 524, such as within a kitchen KT. As discussed above, the new owner can update the modular kitchen cabinet system 524 to suit their own personality, without generating the waste associated with completely gutting a conventional kitchen KT and starting from scratch.

In addition to the ability to update the appearance of the kitchen, some preferred embodiments of the cabinet management system 600 include the most efficient manufacturing techniques currently available today, and use materials with a high "green" factor and recycling ability. For example, all wood products are preferably sourced from suppliers certified by the FSC (Forest Stewardship Council) or the SFI (Sustainable Forest Initiative) programs. The hardware 68 and hinges 112 used with the modular cabinet system 524 are preferably recyclable, and the structural frame system 16 and internal cabinetry shelving systems are preferably made from recyclable aluminum.

Environmental factors are becoming increasingly important in the awarding of contracts for large multi-family projects or for government sponsored construction projects. The modular cabinet system 524 is inherently advantageous for such projects, since the modular structures 12 proactively provide a solution to reduce environmental waste.

Commercial Applications. The modular cabinet system 524 is extremely well suited for use by commercial developers and interior designers for the storage and marketing needs of their clients. The modular cabinetry 12, 100 can be used for functional storage and display in corporate lobbies and conference rooms of high-end businesses such as law firms and fashion and high-trend businesses such as film, technology and advertising firms. The ability to change the fronts 18 easily and cost effectively allows a business to update their look and incorporate current marketing visuals on a regular basis, which creates new excitement for both employees and clients.

For example, businesses such as furniture showrooms and commercial product suppliers, such as for lighting and/or carpets, require substantial but attractive and accessible storage for samples, brochures and technical manuals. The use of the modular cabinetry 12,100 provides an elegant storage solution that also allows for marketing of the products represented by such firms.

Retail Environments. The modular cabinet system 524 is highly suitable for streamlined, combined storage and marketing for retail stores, such as for clothing retailers, upscale boutiques, and/or mass-market retail chain stores, e.g. coffee and/or smoothie retailers. As with the corporate offices, the modular cabinet system 524 provides a readily changeable in-store marketing vehicle, such as to feature the latest ad campaign, new product highlights or seasonal displays that are integrated with the storage requirements of such spaces.

Modular cabinet systems 524 eliminate the duplication of costs for static storage units, and preferred modular structures 12 can provide a dynamic marketing "canvas", such as through the use of changeable full panel face assemblies 12*b* (e.g. having signage or art screened on changeable front assemblies 18), and/or full display panel assemblies 12*d* (e.g. having dynamically changeable signage, art, video, and even sound, on one or more modular cabinets 12*d*).

For developer and retail locations that are associated with the cabinet management system 600, terminals 628*b*,628*n* are preferably located in a showroom or developer sales office (such as at free-standing "kiosks" 640), which are linked. 627*b*,627*n* across the network 604 to a developer portion 630*b* or retail portion 630*n* of the cabinet management system web site 620,630. Potential clients, with assistance from a sales/designer, can play with interactive kitchen models, choose from a selection of available front face assemblies 18, and learn about the easy possibility for upgrading or changing the look of the modular cabinet system 524.

Once a prospective user USR becomes a client, they are typically assigned a kitchen designer/salesperson, who can further assist the client through design, costs, contracts, and/or deposits. For example, while the cabinet management system 600 can preferably guide the client through most design decisions, a supplementary image advisor can assist the client in the selection of front face assemblies 18.

Although the modular cabinet system and methods of use are described herein in connection with cabinet doors and drawers within a kitchen environment, the structures and techniques can be implemented for a wide variety of cabinetry and/or furniture, or any combination thereof, as desired.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

What is claimed is:

1. A modular structure, comprising:

a structural frame comprising a first side and a second side opposite the first side, a hollow region defined between the first side and the second side, and a first end and a second end opposite the first end, wherein the structural frame comprises a removable frame component at the second end, an inner edge which extends into the hollow region, and means for connection to a cabinet element; and a face assembly having a front side, a rear side opposite the front side, a back surface located on the rear side, and a retaining assembly extending rearward from the rear side, wherein the face assembly comprises a central panel having a front surface and a back surface, the back surface defining the rear side of the face assembly, and a face frame having a front surface and a rear surface attached to the central panel, and wherein the retaining assembly is attached to the back surface of the central panel, wherein the face frame comprises a hollow central region defined between the front surface and the back surface, wherein at least a portion of the front surface of the central panel is visible through the hollow central region of the face frame;

wherein the retaining assembly of the face assembly is fixedly retained within the structural frame by the inner edge of the structural frame when the removable frame component is affixed to the frame structure, whereby at least a portion of the back surface of the face assembly extends over at least a portion of the first side of the structural frame; and wherein the retaining assembly of the face assembly is slidably movable in relation to the inner edge of the structural frame when the removable frame component is detached from the structural frame.

2. The modular structure of claim 1, wherein a tongue and groove relationship is defined between the inner edge of the structural frame and.the retaining assembly.

3. The modular structure of claim 1, wherein the modular structure comprises a cabinet door.

4. The modular structure of claim 3, wherein the means for connection to a cabinet element comprises means for mounting at least one hinge at the first end of the structural frame.

5. The modular structure of claim 1, wherein the structural frame comprises:

a first and a second vertical frame member;

a top and a bottom frame member; and corner brackets fixedly attachable to the vertical frame members, which are slidably and removably attachable to at least the second frame member.

6. The modular structure of claim 5, wherein each of the frame members are comprised of an extrusion.

7. The modular structure of claim 6, wherein the extrusions are comprised of any of aluminum and aluminum alloy.

8. The modular structure of claim 5, wherein the frame members comprise mitered corners.

9. The modular structure of claim 5, wherein the first and second vertical frame members and the top and bottom frame members further comprise an outer edge of the structural frame, and wherein the outer edge further comprises any of a groove and a channel defined along the length of the first and second vertical frame members and the top and bottom frame members.

10. The modular structure of claim 9, further comprising:

an object slidably installable within any of the groove and the channel, wherein the object comprises any of a trim piece, a handle, a rack, a filler trim, and an extension to the structural frame.

11. The modular structure of claim 1, wherein the central panel and the face frame are comprised of the same materials.

12. The modular structure of claim 1, wherein any of the face frame and the central panel comprise any of a laminate, wood, paint grade wood, wood veneer, metal, stone, glass, fiberglass, carbon fiber, and plastic.

13. The modular structure of claim 1, wherein any of the face frame and the central panel are finished in any of paint, lacquer, brushed metal, and polished metal.

14. The modular structure of claim 1, wherein the central panel comprises a display screen.

15. The modular structure of claim 1, wherein the structural frame can interchangeably retain either of the face assembly and a full panel style face assembly;

wherein the full panel face assembly comprises a panel having a front surface and a back surface, and wherein the retaining assembly is attached to the back surface of the panel.

16. A modular structure, comprising:

a structural frame comprising a first side and a second side opposite the first side, a hollow region defined between the first side and the second side, and a first end and a second end opposite the first end, wherein the structural frame comprises a removable frame component at the second end, an inner edge which extends into the hollow region, and means for connection to a cabinet element; and a face assembly having a front side, a rear side opposite the front side, a back surface located on the rear side, and a retaining assembly extending rearward from the rear side, wherein the face assembly comprises a central panel having a front surface and a back surface, the back surface defining the rear side of the face assembly, and a face frame having a front surface and a rear surface attached to the central panel, and wherein the retaining assembly is attached to the back surface of the central panel;

wherein the retaining assembly of the face assembly is fixedly retained within the structural frame by the inner edge of the structural frame when the removable frame component is affixed to the frame structure, whereby at least a portion of the back surface of the face assembly extends aver at least a portion of the first side of the structural frame;

wherein the retaining assembly of the face assembly is slidably movable in relation to the inner edge of the structural frame when the removable frame component is detached from the structural frame; and wherein the retaining assembly comprises an elastomer having at least one groove defined thereon, which constrains the face assembly to the structural frame in the closed position, and allows slidable movement of the face assembly in relation to the structural frame when the structural frame is in the open position.

17. The modular structure of claim 16, wherein the modular structure comprises a cabinet door.

18. The modular structure of claim 17, wherein the means for connection to a cabinet element comprises means for mounting at least one hinge at the first end of the structural frame.

19. The modular structure of claim 16, wherein the modular structure comprises a cabinet drawer.

20. The modular structure of claim 19, wherein the means for connection to a cabinet element comprises means for mounting a drawer box.

21. The modular structure of claim 16, wherein the structural frame comprises:

a first and a second vertical frame member;

a top and a bottom frame member; and corner brackets fixedly attachable to the vertical frame members, which are slidably and removably attachable to at least the second frame member.

22. The modular structure of claim 21, wherein each of the frame members are comprised of an extrusion.

23. The modular structure of claim 22, wherein the extrusions are comprised of any of aluminum and aluminum alloy.

24. The modular structure of claim 21, wherein the frame members comprise mitered corners.

25. The modular structure of claim 21, wherein the first and second vertical frame members and the top and bottom frame members further comprise an outer edge of the structural frame, and wherein the outer edge further comprises any of a groove and a channel defined along the length of the first and second vertical frame members and the top and bottom frame members.

26. The modular structure of claim 25, further comprising:

an object slidably installable within any of the groove and the channel, wherein the object composes any of a trim piece, a handle, a rack, a filler trim, and an extension to the structural frame.

27. The modular structure of claim 16, wherein the elastomer is chosen based on any of dimensional tolerance, compliance, minimizing rattles between the face assembly and the structural frame, and sound-deadening characteristics.

28. The modular structure of claim 16, wherein the elastomer comprises at least one of any of a molded part and an extruded part.

29. The modular structure of claim 16 wherein the retaining assembly is adhesively attached to the back surface of the central panel.

30. The modular structure of claim 16, wherein the central panel and the face frame are comprised of the same materials.

31. The modular structure of claim 16 wherein any of the face frame and the central panel comprise any of a laminate, wood, paint grade wood, wood veneer, metal, stone, glass, fiberglass, carbon fiber, and plastic.

32. The modular structure of claim 16, wherein any of the face frame and the central panel are finished in any of paint, lacquer, brushed metal, and polished metal.

33. The modular structure of claim 16, wherein the central panel comprises a display screen.

34. The modular structure of claim 16, wherein the structural frame can interchangeably retain either of the face assembly and a full panel style face assembly;

wherein the full panel face assembly comprises a panel having a front surface and a back surface, and wherein the retaining assembly is attached to the back surface of the panel.

35. The modular structure of claim 16, wherein a tongue and groove relationship is defined between the inner edge of the structural frame and the retaining assembly.

36. A modular cabinet system installable within a location, comprising:

a least one cabinet carcass installable at the location; and at least one modular structure connected to the cabinet carcass, wherein the modular structure comprises a structural frame comprising a first side and a second side opposite the first side, a hollow region defined between the first side and the second side, and a first end and a second end opposite the first end, wherein the structural frame comprises a removable frame component at the second end, and an inner edge which extends into the hollow region; and a face assembly having a front side, a rear side opposite the front side, a back surface located on the rear side, and a retaining assembly extending rearward from the rear side, wherein the face assembly comprises a central panel having a front surface and a back surface, the back surface defining the rear side of the face assembly, and a face frame having a front surface and a rear surface attached to the central panel, wherein the face frame comprises a hollow central region defined therethrough between the front surface and the back surface, wherein at least a portion of the front surface of the central panel is visible through the hollow central region of the face frame, and wherein the retaining assembly is attached to the back surface of the central panel;

wherein the retaining assembly is fixedly retained within the structural frame by the inner edge of the structural frame when the removable frame component is affixed to the structural frame whereby at least a portion of the back surface of the face assembly extends over at least a portion of the front surface of the structural frame; and wherein the retaining assembly is slidably movable in relation to the inner edge of the structural frame when the removable frame component is detached from the structural frame.

37. The modular cabinet system of claim 36, wherein a tongue and groove relationship is defined between the inner edge of the structural frame and the retaining assembly.

38. The modular cabinet system of claim 36, wherein the location comprises any of a kitchen, an office, a work room, a bedroom, a bathroom, a lobby, and a store.

39. The modular cabinet system of claim 36, wherein the modular structure comprises a cabinet door.

40. The modular cabinet system of claim 39, wherein the first end of the structural frame comprises means for mounting at least one hinge.

41. The modular cabinet system of claim 36, wherein the structural frame comprises:

a first and a second vertical frame member;

a top and a bottom frame member, and corner brackets fixedly attachable to the vertical frame members, which are slidably and removably attachable to at least the second frame member.

42. The modular cabinet system of claim 41, wherein each of the frame members are comprised of an extrusion.

43. The modular cabinet system of claim 42, wherein the extrusions are comprised of any of aluminum and aluminum alloy.

44. The modular cabinet system of claim 42, wherein the first and second vertical frame members and the top and bottom frame members further comprise an outer edge of the structural frame, wherein the outer edge further comprises any of a groove and a channel defined along the length of the first and second vertical frame members and the top and bottom frame members.

45. The modular cabinet system of claim 44, further comprising:

an object slidably installable within any of the groove and the channel, wherein the object comprises any of a trim piece, a handle, a rack, a filler trim, and an extension to the structural frame.

46. The modular cabinet system of claim 41, wherein the frame members comprise mitered corners.

47. The modular cabinet system of claim 36, wherein the central panel and the face frame are comprised of the same materials.

48. The modular cabinet system of claim 36, wherein any of the face frame and the central panel comprise any of a laminate, wood, paint grade wood, wood veneer, metal, stone, glass, fiberglass, carbon fiber, and plastic.

49. The modular cabinet system of claim 36, wherein any of the face frame and the central panel are finished in any of paint, lacquer, brushed metal, and polished metal.

50. The modular cabinet system of claim 36, wherein the central panel comprises a display screen.

51. A modular cabinet system installable within a location, comprising:

a least one cabinet carcass installable at the location; and at least one modular structure connected to the cabinet carcass, wherein the modular structure comprises a structural frame comprising a first side and a second side opposite the first side, a hollow region defined between the first side and the second side, and a first end and a second end opposite the first end, wherein the structural frame comprises a removable frame component at the second end, and an inner edge which extends into the hollow region; and a face assembly having a front side, a rear side opposite the front side, a back surface located on the rear side, and a retaining assembly extending rearward from the rear side, wherein the face assembly comprises a central panel having a front surface and a back surface, the back surface defining the rear side of the face assembly and a face frame having a front surface and a rear surface attached to the central panel, and wherein the retaining assembly is attached to the back surface of the central panel;

wherein the retaining assembly is fixedly retained within the structural frame by the inner edge of the structural frame when the removable frame component is affixed to the structural frame, whereby at least a portion of the back surface of the face assembly extends over at least a portion of the front surface of the structural frame;

wherein the retaining assembly is slidably movable in relation to the inner edge of the structural frame when the removable frame component is detached from the structural frame; and wherein the retaining assembly comprises an elastomer having at least one groove defined thereon, which constrains the face assembly to the structural frame in the closed position, and allows slidable movement of the face assembly in relation to the structural frame when the structural frame is in the open, position.

52. The modular cabinet system of claim 51, wherein the location comprises any of a kitchen; an office, a work room, a bedroom, a bathroom, a lobby, and a store.

53. The modular cabinet system of claim 51, wherein the modular structure comprises a cabinet door.

54. The modular cabinet system of claim 53, wherein the first end of the structural frame comprises means for mounting at least one hinge.

55. The modular cabinet system of claim 51 wherein the modular structure comprises a cabinet drawer front.

56. The modular cabinet system of claim 55, wherein at least a portion of the structural frame comprises means for mounting a drawer box that is slidably connected to the cabinet carcass.

57. The modular cabinet system of claim 51, wherein the structural frame comprises:

a first and a second vertical frame member;

a top and a bottom frame member; and corner brackets fixedly attachable to the vertical frame members, which are slidably and removably attachable to at least the second frame member.

58. The modular cabinet system of claim 57, wherein each of the frame members are comprised of an extrusion.

59. The modular cabinet system of claim 58, wherein the extrusions are comprised of any of aluminum and aluminum alloy.

60. The modular cabinet system of claim 57, wherein the first and second vertical frame members and the top and bottom frame members further comprise an outer edge of the structural frame, wherein the outer edge further comprises any of a groove and a channel defined along the length of the first and second vertical frame members and the top and bottom frame members.

61. The modular cabinet system of claim 60, further comprising:

an object slidably installable within any of the groove and the channel, wherein the object comprises any of a trim piece, a handle, a rack, a filler trim, and an extension to the structural frame.

62. The modular cabinet system of claim 57, wherein the frame members comprise mitered corners.

63. The modular cabinet system of claim 51, wherein the elastomer is chosen based on any of compliance, minimizing rattles between the face assembly and the structural frame, and sound-deadening characteristics.

64. The modular cabinet system of claim 51, wherein the elastomer comprises at least one of any of a molded part and an extruded part.

65. The modular cabinet system of claim 51 wherein the retaining assembly is adhesively attached to the back surface of the central panel.

66. The modular cabinet system of claim 51 wherein the central panel and the face frame are comprised of the same materials.

67. The modular cabinet system of claim 51, wherein any of the face frame and the central panel comprise any of a laminate, wood, paint grade wood, wood veneer, metal, stone, glass, fiberglass, carbon fiber, and plastic.

68. The modular cabinet system of claim 51, wherein any of the face frame and the central panel are finished in any of paint, lacquer, brushed metal, and polished metal.

69. The modular cabinet system of claim 51, wherein the central panel comprises a display screen.

70. The modular cabinet system of claim 51 wherein the structural frame can interchangeably retain either of the face assembly and a full panel style face assembly:

wherein the full panel face assembly comprises a panel having a front surface and a back surface, and wherein the retaining assembly is attached to the back surface of the panel.

71. The modular cabinet system of claim 51, wherein a tongue and groove relationship is defined between the inner edge of the structural frame and the retaining assembly.

* * * * *